US010446114B2

(12) United States Patent
Whitehead et al.

(10) Patent No.: US 10,446,114 B2
(45) Date of Patent: Oct. 15, 2019

(54) ADJUSTING COLOR PALETTES USED FOR DISPLAYING IMAGES ON A DISPLAY DEVICE BASED ON AMBIENT LIGHT LEVELS

(71) Applicant: QUALCOMM Incorporated, San Diego, CA (US)

(72) Inventors: Nathan Oliver John Whitehead, Sunnyvale, CA (US); Prasanna Chandrakant Inamdar, San Diego, CA (US); Shiae Park, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 85 days.

(21) Appl. No.: 15/712,073

(22) Filed: Sep. 21, 2017

(65) Prior Publication Data

US 2018/0350323 A1 Dec. 6, 2018

Related U.S. Application Data

(60) Provisional application No. 62/513,819, filed on Jun. 1, 2017.

(51) Int. Cl.

| | |
|---|---|
| ***G09G 5/06*** | (2006.01) |
| ***G09G 3/20*** | (2006.01) |
| ***G09G 5/02*** | (2006.01) |

(52) U.S. Cl.

CPC ..... *G09G 5/06* (2013.01); *G09G 3/2003* (2013.01); *G09G 5/026* (2013.01); (Continued)

(58) Field of Classification Search

CPC ..... G09G 5/06; G09G 5/026; G09G 3/2003; G09G 2320/0693; G09G 2360/144; G09G 2320/0666; G09G 2360/141

See application file for complete search history.

(56) References Cited

U.S. PATENT DOCUMENTS

| | | | |
|---|---|---|---|
| 4,965,574 | A | 10/1990 | Fukushima et al. |
| 8,817,002 | B2 | 8/2014 | Robinson et al. |

(Continued)

FOREIGN PATENT DOCUMENTS

| | | | |
|---|---|---|---|
| FR | 2782566 | A1 | 2/2000 |
| JP | H11109920 | A | 4/1999 |

(Continued)

OTHER PUBLICATIONS

International Search Report and Written Opinion—PCT/US2018/033433—ISA/EPO—dated Nov. 22, 2018.

(Continued)

*Primary Examiner* — Ibrahim A Khan

(74) *Attorney, Agent, or Firm* — Arent Fox, LLP

(57) ABSTRACT

In an aspect of the disclosure, a method, a computer-readable medium, and an apparatus of adjusting color palettes for a display device based on ambient light levels are provided. The apparatus determines a first ambient light level based at least in part on first information received from one or more sensors. A first color palette associated with the first ambient light level is generated. The apparatus determines a first screen brightness level associated with the first ambient light level and displays a first image on a display screen using the first color palette and the first screen brightness level.

52 Claims, 13 Drawing Sheets

(52) U.S. Cl.
CPC ..... *G09G 2320/0666* (2013.01); *G09G 2320/0693* (2013.01); *G09G 2360/141* (2013.01); *G09G 2360/144* (2013.01)

(56) References Cited

U.S. PATENT DOCUMENTS

| | | | | |
|---|---|---|---|---|
| 8,847,972 | B2 | 9/2014 | Kane et al. | |
| 8,860,653 | B2 | 10/2014 | Mahowald et al. | |
| 2002/0030620 | A1 | 3/2002 | Cairns et al. | |
| 2003/0201990 | A1 | 10/2003 | Aldrich et al. | |
| 2004/0189610 | A1 | 9/2004 | Friend et al. | |
| 2005/0012735 | A1 | 1/2005 | Low et al. | |
| 2005/0037815 | A1 | 2/2005 | Besharat et al. | |
| 2005/0117458 | A1 | 6/2005 | Claessens et al. | |
| 2005/0190197 | A1 | 9/2005 | Ebi | |
| 2007/0013645 | A1 | 1/2007 | Baba et al. | |
| 2008/0303918 | A1 | 12/2008 | Keithley | |
| 2009/0167950 | A1* | 7/2009 | Chen | G06F 3/14 348/602 |
| 2010/0225628 | A1* | 9/2010 | Souchkov | G01J 1/4204 345/207 |
| 2010/0296370 | A1 | 11/2010 | Holmes et al. | |
| 2011/0050695 | A1* | 3/2011 | Sullivan | G06T 11/001 345/426 |
| 2011/0134252 | A1* | 6/2011 | Furukawa | H04N 5/44504 348/177 |
| 2012/0079018 | A1* | 3/2012 | Rottler | H04M 1/72572 709/204 |
| 2013/0120656 | A1* | 5/2013 | Wilson | G06F 3/1462 348/563 |
| 2014/0168288 | A1 | 6/2014 | Tusch et al. | |
| 2014/0285477 | A1* | 9/2014 | Cho | G09G 3/2003 345/207 |
| 2015/0061990 | A1* | 3/2015 | Toner | G06F 3/013 345/156 |
| 2015/0332622 | A1* | 11/2015 | Liu | G09G 3/2003 705/14.54 |
| 2016/0111062 | A1 | 4/2016 | Hicks | |
| 2016/0210934 | A1* | 7/2016 | Halfman | G09G 3/3433 |
| 2016/0232828 | A1 | 8/2016 | Jia et al. | |
| 2016/0240167 | A1* | 8/2016 | Breazile | G09G 5/10 |
| 2016/0314763 | A1* | 10/2016 | Matthews | G09G 5/02 |
| 2017/0109029 | A1* | 4/2017 | Lee | G09G 5/06 |
| 2017/0168655 | A1* | 6/2017 | Jann | G06F 3/0481 |
| 2017/0228895 | A1* | 8/2017 | Lee | H04N 21/44008 |
| 2017/0229059 | A1* | 8/2017 | Bonnier | G09G 5/10 |
| 2018/0189983 | A1* | 7/2018 | Lee | H04N 9/00 |

FOREIGN PATENT DOCUMENTS

| | | | |
|---|---|---|---|
| KR | 20030000591 | A | 1/2003 |
| WO | 2009002603 | A1 | 12/2008 |

OTHER PUBLICATIONS

Partial International Search Report—PCT/US2018/033433—ISA/EPO—dated Jul. 30, 2018.

* cited by examiner

ADJUSTING COLOR PALETTES USED FOR DISPLAYING IMAGES ON A DISPLAY DEVICE BASED ON AMBIENT LIGHT LEVELS

CROSS-REFERENCE TO RELATED APPLICATION(S)

This application claims the benefit of U.S. Provisional Application Ser. No. 62/513,819, entitled "ADJUSTING COLOR PALETTES USED FOR DISPLAYING IMAGES ON A DISPLAY DEVICE BASED ON AMBIENT LIGHT LEVELS" and filed on Jun. 1, 2017, which is expressly incorporated by reference herein in its entirety.

BACKGROUND

Field

The present disclosure relates generally to a display device, and more particularly, to a technique for adjusting color palettes used for displaying images on the display device based on ambient light levels.

Background

Digital display devices (e.g., digital smartwatches, smartphones, tablet devices, smart televisions, etc.) may employ display technologies such as a backlit liquid crystal display (LCD), or an active-matrix organic light-emitting diodes (AMOLED) to illuminate pixels on a display screen. Because LCD and AMOLED technologies generate the light used to illuminate pixels, displayed images may be easily visible in low ambient light environments (e.g., such as in a darkened movie theater). In certain scenarios, however, display devices illuminated in low ambient light environments may cause eye strain, disrupt sleeping patterns of a user sleeping in proximity to the display device, or cause distraction to other people in the low ambient light environment (e.g., such as in a darkened movie theater).

Thus, there is a need for a technique to adapt images displayed on a digital display device based on different ambient light levels such that the images are visible to the user, and the potential for eye strain and/or the distraction to others in a low ambient light environment is reduced.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

Digital display devices (e.g., digital smartwatches, smartphones, tablet devices, smart televisions, etc.) may employ display technologies such as a backlit LCD, or an AMOLED to illuminate pixels on a display screen. Because LCD and AMOLED technologies generate the light used to illuminate pixels, displayed images may be easily visible in low ambient light environments (e.g., such as in a darkened movie theater). In certain scenarios, however, display devices illuminated in low ambient light environments may cause eye strain, disrupt sleeping patterns of a user sleeping in proximity to the display device, or cause distraction to other people in the low ambient light environment (e.g., such as in a darkened movie theater).

Thus, there is a need for a technique to adapt images displayed on a digital display device to different ambient light levels such that the images are visible to the user, and that the potential for eye strain and/or distraction to others in a low ambient light environment is reduced. Such a transition technique may reduce the eye strain and/or distraction to others in a low ambient light environment while retaining image visibility to the user.

The present disclosure provides a technique to transition between different color palettes and/or screen brightness levels used for displaying graphical assets and/or timekeeping information on a display device based on different ambient light levels without increasing the amount of memory used to store graphical assets.

In an aspect of the disclosure, a method, a computer-readable medium, and an apparatus are provided. The apparatus may determine a first ambient light level based at least in part on first information received from one or more sensors. The apparatus may generate a first color palette associated with the first ambient light level. The apparatus may determine a first screen brightness level associated with the first ambient light level. The apparatus may display a first image on a display screen using the first color palette and the first screen brightness level.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

DETAILED DESCRIPTION

Figure 1A:
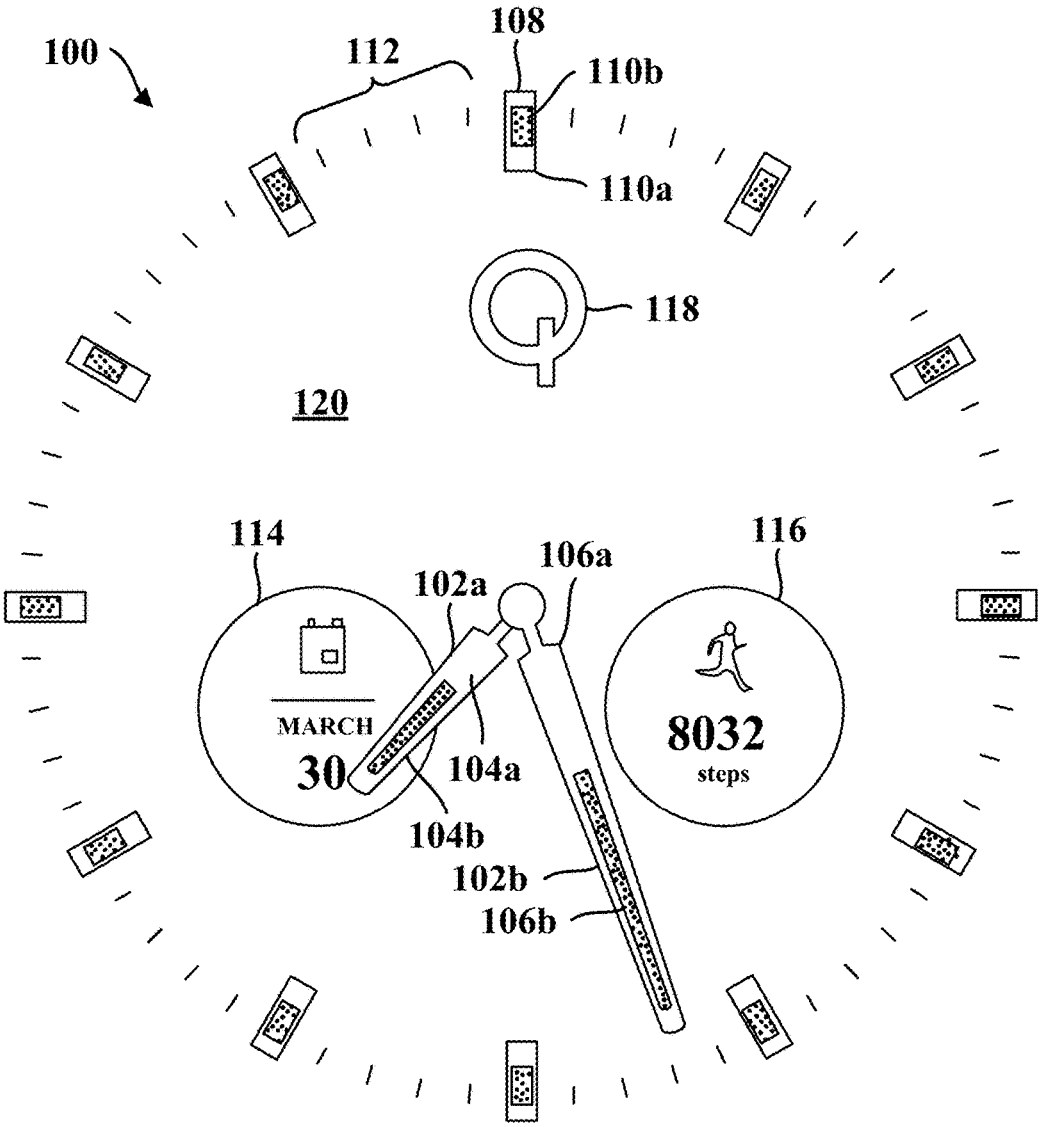
FIGS. 1A-1D are diagrams illustrating an example technique for adjusting color palettes used for displaying images on a display device based on ambient light levels in accordance with certain aspects of the disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, as will be apparent to those skilled in the art such concepts may be practiced without the specific details. In some instances, well known structures and components are shown in block diagram form in order to avoid obscuring such concepts.

Several aspects of display devices will now be presented with reference to various apparatus and methods. These apparatus and methods will be described in the following detailed description and illustrated in the accompanying drawings by various blocks, components, circuits, processes, algorithms, etc. (collectively referred to as "elements"). These elements may be implemented using electronic hardware, computer software, or any combination thereof. Whether such elements are implemented as hardware or software depends upon the particular application and design constraints imposed on the overall system.

By way of example, an element, or any portion of an element, or any combination of elements may be implemented as a "processing system" that includes one or more processors. Examples of processors include microprocessors, microcontrollers, graphics processing units (GPUs), central processing units (CPUs), application processors, digital signal processors (DSPs), reduced instruction set computing (RISC) processors, systems on a chip (SoC), baseband processors, field programmable gate arrays (FPGAs), programmable logic devices (PLDs), state machines, gated logic, discrete hardware circuits, and other suitable hardware configured to perform the various functionality described throughout this disclosure. One or more processors in the processing system may execute software. Software shall be construed broadly to mean instructions, instruction sets, code, code segments, program code, programs, subprograms, software components, applications, software applications, software packages, routines, subroutines, objects, executables, threads of execution, procedures, functions, etc., whether referred to as software, firmware, middleware, microcode, hardware description language, or otherwise.

Accordingly, in one or more example embodiments, the functions described may be implemented in hardware, software, or any combination thereof. If implemented in software, the functions may be stored on or encoded as one or more instructions or code on a computer-readable medium. Computer-readable media includes computer storage media. Storage media may be any available media that can be accessed by a computer. By way of example, and not limitation, such computer-readable media can comprise a random-access memory (RAM), a read-only memory (ROM), an electrically erasable programmable ROM (EEPROM), optical disk storage, magnetic disk storage, other magnetic storage devices, combinations of the aforementioned types of computer-readable media, or any other medium that can be used to store computer executable code in the form of instructions or data structures that can be accessed by a computer.

Digital display devices (e.g., digital smartwatches, smartphones, tablet devices, smart televisions, etc.) may employ display technologies such as a backlit LCD, or an AMOLED to illuminate pixels on a display screen. Because LCD and AMOLED technologies generate the light used to illuminate pixels, displayed images may be easily visible in low ambient light environments (e.g., such as in a darkened movie theater). In certain scenarios, however, display devices illuminated in low ambient light environments may cause eye strain, disrupt sleeping patterns for a user sleeping in proximity to the display device, or cause distraction to other people in the low ambient light environment (e.g., such as in a darkened movie theater).

Analog mechanical display devices (e.g., analog mechanical watches) may use phosphorescent paint to illuminate displayed images in low ambient light environments, e.g., at night or deep underwater. Sunlight or any other bright light impinging on the phosphorescent paint may cause energy to be stored in the phosphorescent paint. In low ambient light environments, the phosphorescent paint may release the stored energy as an emitted phosphorescent glow. In certain implementations, the phosphorescent glow may be green in color, and be bright enough to be visible in a low ambient light environment.

Digital display devices do not need phosphorescent paint to make the display visible in low ambient light environments because digital display devices employ display technologies such as a backlit LCD, or an AMOLED to illuminate pixels on a display screen. Certain users may appreciate the analog mechanical display device aesthetic. Recreating the look of phosphorescent paint in digital display devices may have certain desirable aspects. For example, the phosphorescent glow of the analog mechanical display device aesthetic may be used as part of a digital recreation of the analog digital display. Simulating the appearance of a phosphorescent glow in a digital display device may provide a solution the problem of how to selectively illuminate the digital display to provide a visible image in low ambient light environments while reducing eye strain and/or reducing excess illumination that may cause annoyance to others.

Simulating the appearance of glowing phosphorescent paint in a digital display device may involve both a graphical design component, and several technical challenges related to, e.g., power consumption, rendering efficiency, and graphical asset size restrictions. The present disclosure addresses the technical challenges associated with simulating glowing phosphorescent paint in a digital display device.

When the digital display device is a digital smartwatch, simulating the behavior of a mechanical watch may include illuminating the screen at all times so that the watch hands are visible on the display screen at all times. Because of battery constraints, constant illumination of the display screen may not be feasible. However, the longer the display screen can be turned on with correct lighting and correct graphical output the more realistic the simulation of mechanical watch behavior may be. In order to maintain power consumption below a threshold while still updating the display screen (e.g., displaying the movement of the hour hand and/or minute hand), the display device may be configured to reduce computational work and reduce the amount of RAM used for rendering the updated images on the digital display device.

One problem associated with analog mechanical watches is that analog mechanical watches may not exhibit discrete "steps" in the transition from a low ambient light environment (e.g., a movie theater with the overhead lights on) to glowing in a dark ambient light environment (e.g., a darkened movie theater). In other words, the phosphorescent glow emitted by the phosphorescent paint is generally the same brightness in different low ambient light levels.

A digital simulation of a watch face (e.g., on a digital smartwatch) may be designed such that the image of the watch face changes based on different ambient light conditions. In other words, depending on the ambient light level, different parts of the watch face may be visible. For example, in bright ambient light environments, the entire watch face (e.g., all of the graphical assets maintained for the watch face) may be displayed in full detail. However, in lower ambient light environments, only portions of the hour hand and/or minute hand may be visible.

In certain implementations, different graphical assets (e.g., images) for the watch face background, hour hand, and minute hand may be stored and associated with a plurality of different ambient light levels. For a realistic simulated transition between light ambient light conditions and dark ambient light conditions, e.g., ten different images for ten different ambient light levels may need to be maintained. Maintaining ten different images for a watch face may increase the amount of memory used to maintain watch face graphical assets (e.g., images) by a factor or ten. By increasing the amount of memory used to store watch face graphical assets (e.g., by a factor of ten), the graphical assets associated with each of the different ambient light levels may need to be compressed (e.g., by a factor of ten), which may lower the visual quality of the displayed watch face. For example, due to the limited amount of memory in digital display devices, only a fraction of the memory (e.g., 100 kibibytes (KiB)) may be allocated for maintaining watch face assets. Increasing the number of watch faces assets that are maintained in, e.g., 100 KiB of memory may require maintaining lower resolution watch face assets or monochromatic watch face assets in order to stay within the 100 KiB.

Thus, there is a need for a technique to adapt images displayed on a digital display device to different ambient light levels such that the images are visible to the user, while reducing the potential for eye strain and/or distraction others in a low ambient light environment.

The present disclosure provides a solution by transitioning between different color palettes and/or screen brightness levels used for displaying graphical assets and/or timekeeping information on a display device based on different ambient light levels.

FIGS. 1A-1D are diagrams illustrating a display device 100, 115, 130, 145 that may be configured to adjust color palettes used for displaying images on a display device based on ambient light levels in accordance with certain aspects of the disclosure. In addition, FIGS. 1A-1D depict a display device 100, 115, 130, 145 in environments with different ambient light levels.

Figure 1B:
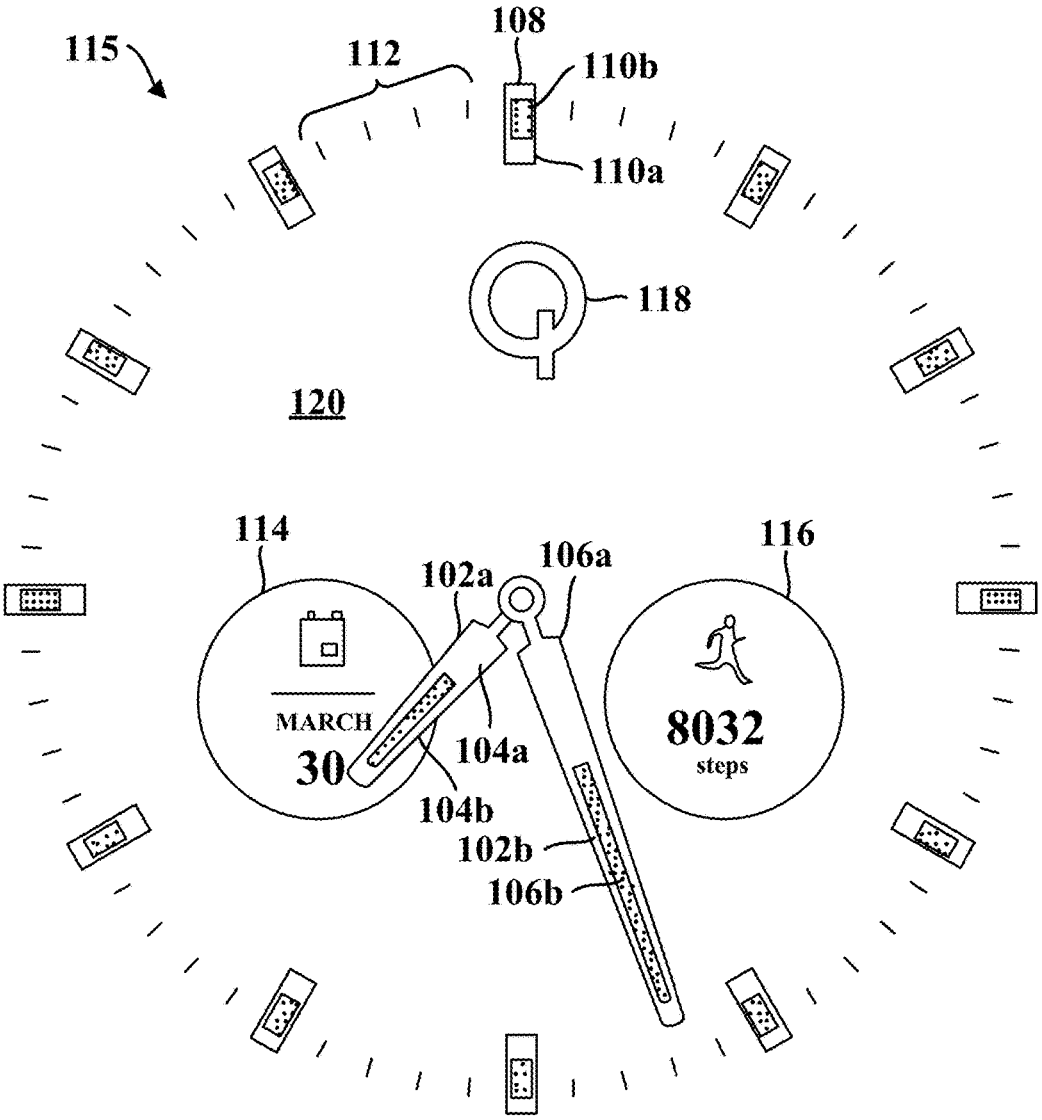
Figure 1C:
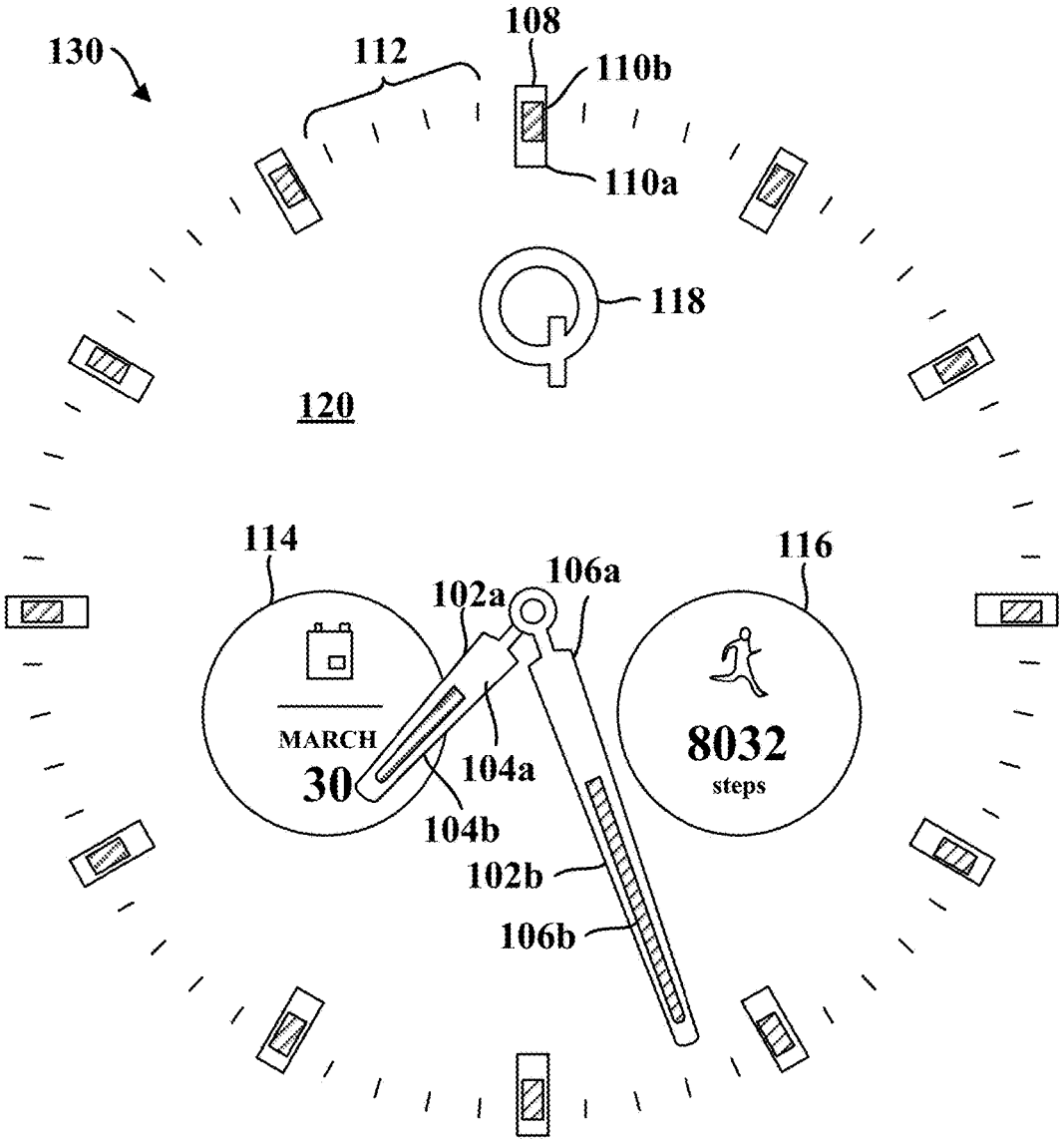
Figure 1D:
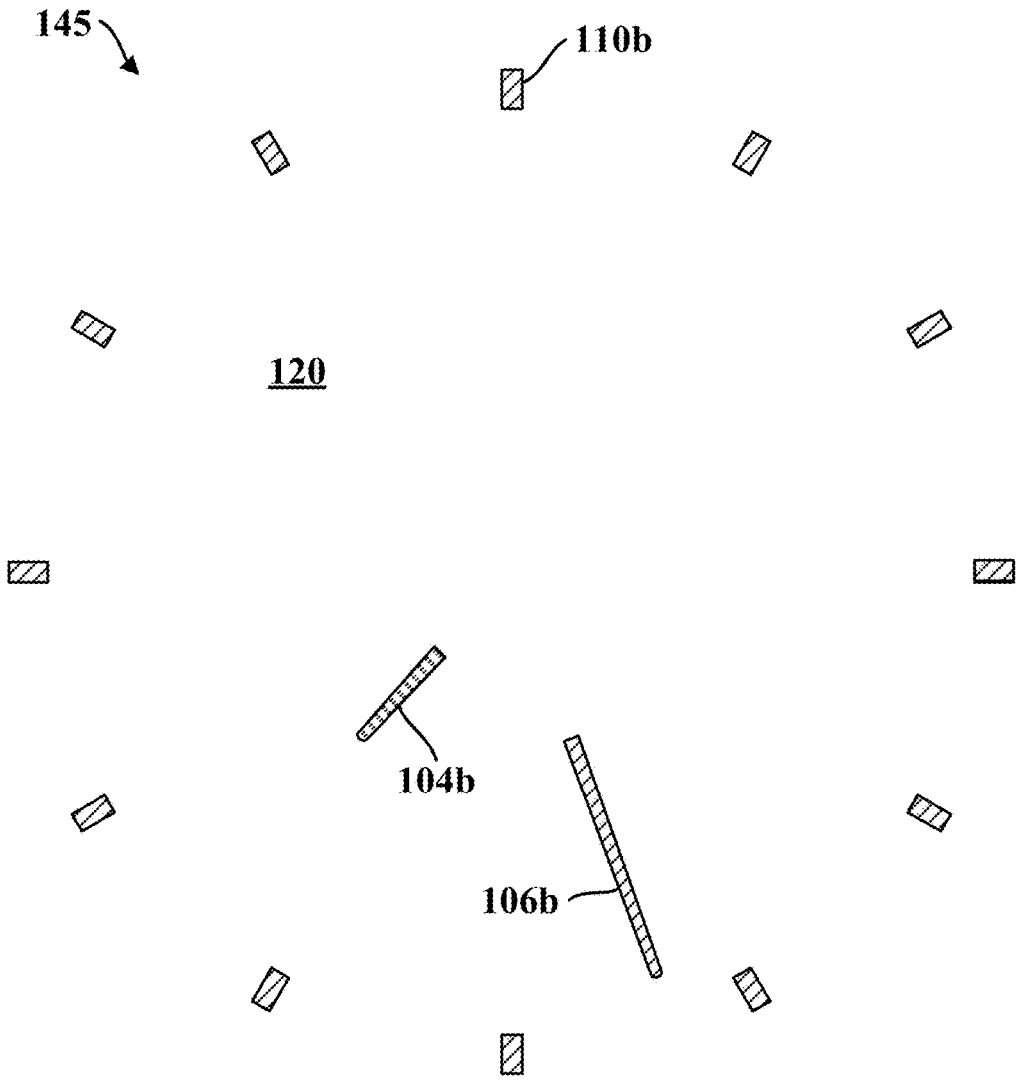
Figure 1E:
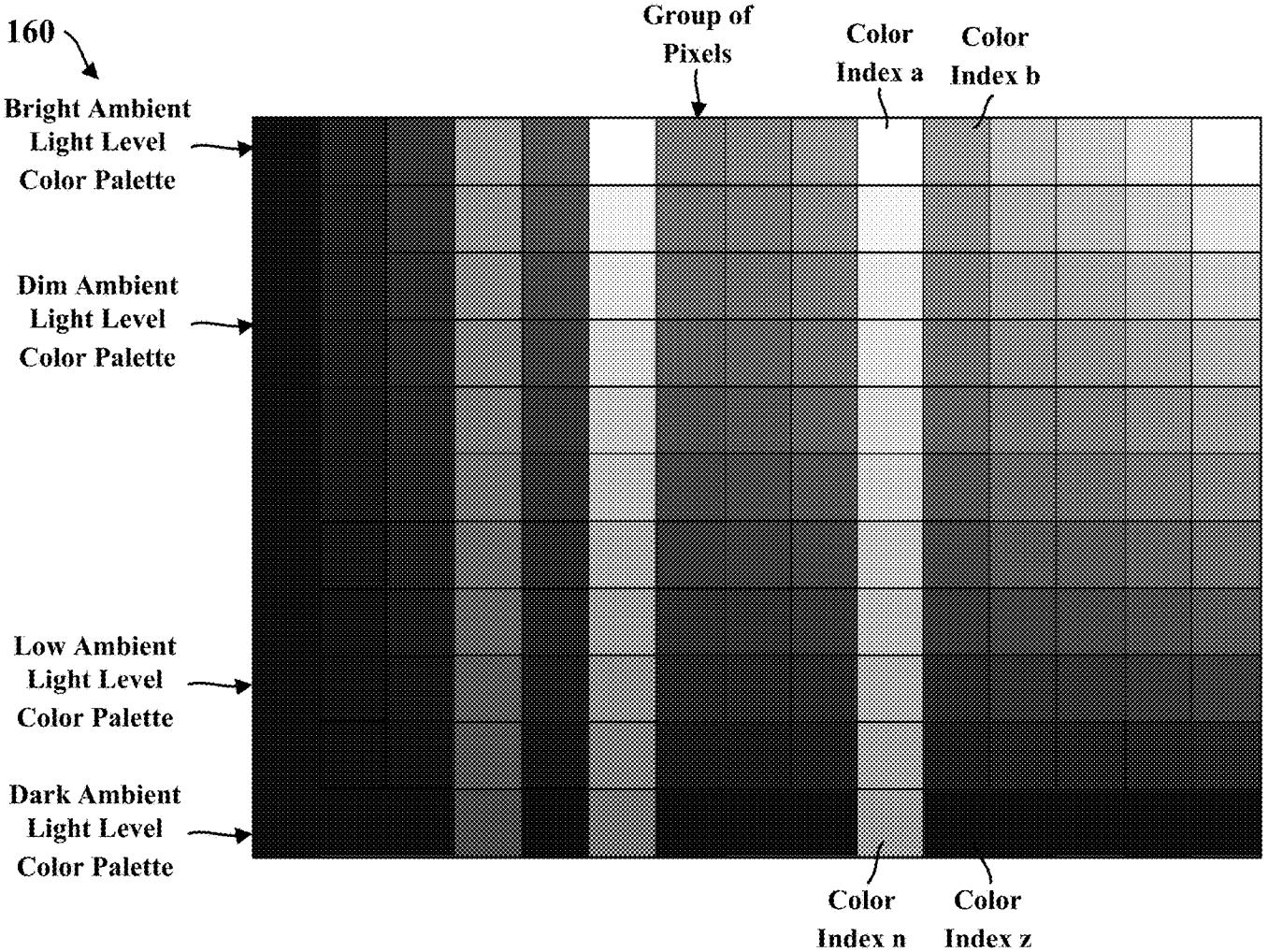
FIGS. 1E and 1F are diagrams illustrating example color palettes that may be interpolated for use is displaying an image on a display device based on an ambient light level in accordance with certain aspects of the disclosure.
Figure 1F:
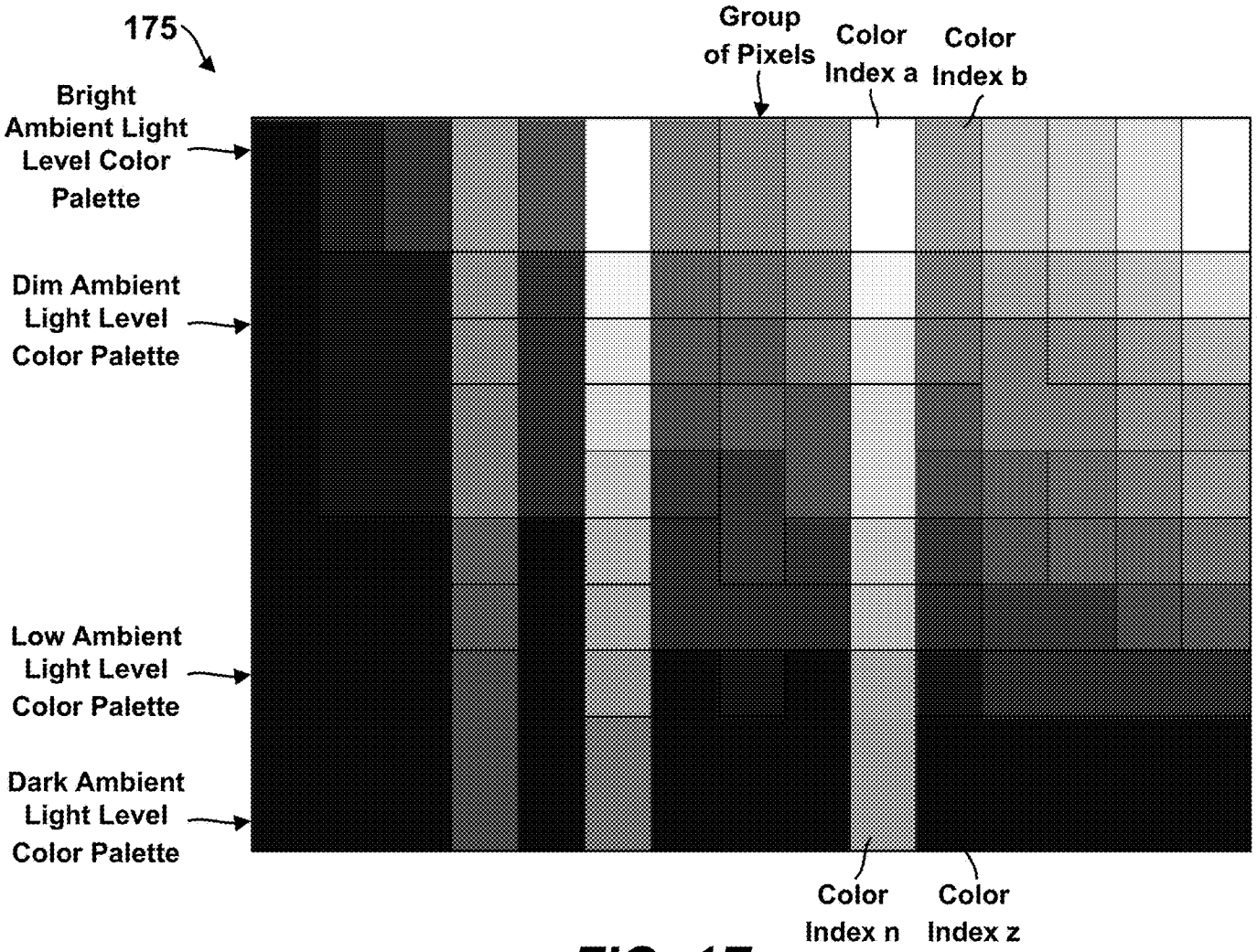

FIGS. 1E and 1F are diagrams illustrating example color palettes 160, 175 that may be interpolated for use in displaying an image on the display device (e.g., display device 100, 115, 130, 145 illustrated in FIGS. 1A-1D) based on an ambient light level in accordance with certain aspects of the disclosure.

Of the display devices 100, 115, 130, 145 illustrated in FIGS. 1A-1D, the display device 100 illustrated in FIG. 1A is depicted in an environment with the brightest ambient light level. The display device 115 illustrated in FIG. 1B is depicted in an environment with the second brightest ambient light level (e.g., dim ambient light). The display device 130 illustrated in FIG. 1C is depicted in an environment with the second lowest ambient light level (e.g., low ambient light). The display device 145 illustrated in FIG. 1D is depicted in an environment with the lowest ambient light level (e.g., a dark environment).

For illustrative purposes, the display device 100, 115, 130, 145 is depicted as a watch face of a digital smartwatch in FIGS. 1A-1D. However, one of ordinary skill in the art understands that the discussion of FIGS. 1A-1D set forth below is not limited to a digital watch face, but may be applicable to any type of digital display device (e.g., a smartphone, a table device, a smart television, etc.) without departing from the scope of the present disclosure.

The display device 100, 115, 130, 145 may periodically sample the ambient light level, determine the appropriate color palette, and render watch face graphical assets using the determined color palette and brightness level. In accordance with aspects of the present disclosure, a color palette is a set of fixed colors. In certain implementations, in an environment with bright ambient light, all graphical assets associated with the watch face may be rendered on the display device (e.g., as illustrated in FIG. 1A). In certain other implementations, one or more graphical assets rendered for a bright light environment may not be rendered for a dark ambient light environment (e.g., as illustrated in FIG. 1D).

For example, FIG. 1A depicts a display device 100 in bright ambient light. The display device 100 may render graphical assets that include, e.g., a minute hand **102*a* that includes a first number of pixels 104*a* illuminated as a first color (e.g., taupe) and a second number of pixels 104*b* illuminated as a second color (e.g., white) that may be different than the first color. In addition, the graphical assets rendered by the display device 100 may include an hour hand 102*b* that includes a first number of pixels 106*a* illuminated as a first color (e.g., taupe) and a second number of pixels 106*b* illuminated as a second color (e.g., white) that may be different than the first color. The display device 100 may also render minute tick marks 112, and five minute tick marks 108. The minute tick marks 112 may include a first number of pixels illuminated as a particular color (e.g., white). The five minute tick marks 108 may include a first number of pixels 110*a* illuminated as a first color (e.g., taupe) and a second number of pixels 110*b* illuminated as a second color (e.g., white) that may be different than the first color. In certain implementation, the display device 100 may render graphical assets that include calendar graphics 114, pedometer graphics 116, logo graphics 118, and/or a background 120. Each of the calendar graphics 114, pedometer graphics 116, the logo graphics 118, and the background 120 may include pixels that are illuminated as particular colors in a bright light environment. For example, the pixels used to render the calendar graphics 114, the pedometer graphics 116, and the logo graphics 118 may be illuminated as a first color (e.g., taupe). The background 120 may be illuminated as a second color (e.g., black). In addition, the display device 100** may display the graphical assets at a brightness level that may be bright enough to be visible in a bright ambient light environment.

For example, FIG. 1B depicts a display device 115 in dim ambient light. The display device 115 may render graphical assets that include, e.g., a minute hand **102*a* that includes a first number of pixels 104*a* illuminated as a first color (e.g., medium brown) and a second number of pixels 104*b* illuminated as a second color (e.g., light green) that may be different than the first color. In addition, the graphical assets rendered by the display device 115 may include an hour hand 102*b* that includes a first number of pixels 106*a* illuminated as a first color (e.g., medium brown) and a second number of pixels 106*b* illuminated as a second color (e.g., light green) that may be different than the first color. The display device 115 may also render minute tick marks 112, and five minute tick marks 108. The minute tick marks 112 may include a first number of pixels illuminated as a particular color (e.g., medium brown). The five minute tick marks 108 may include a first number of pixels 110*a* illuminated as a first color (e.g., medium brown) and a second number of pixels 110*b*** illuminated as a second color (e.g., light green) that may be different than the first color.

In certain implementation, the display device 115 may render graphical assets that include calendar graphics 114, pedometer graphics 116, logo graphics 118, and/or a background 120. Each of the calendar graphics 114, pedometer graphics 116, the logo graphics 118, and the background 120 may include pixels that are illuminated as particular colors in a dim light environment. For example, the pixels used to render the calendar graphics 114, the pedometer graphics 116, and the logo graphics 118 may be illuminated as a first color (e.g., gray). The background 120 may be illuminated as a second color (e.g., black). In addition, the display device 115 may display the graphical assets at a brightness level that is less than that used to display the graphical assets in FIG. 1A.

For example, FIG. 1C depicts a display device 130 in low ambient light (e.g., the low ambient light level of FIG. 1C being less than the dim ambient light level discussed supra with respect to FIG. 1B). The display device 130 may render graphical assets that include, e.g., a minute hand 102*a* that includes a first number of pixels 104*a* illuminated as a first color (e.g., dark brown) and a second number of pixels 104*b* illuminated as a second color (e.g., light phosphorescent green) that may be different than the first color. In addition, the graphical assets rendered by the display device 130 may include an hour hand 102*b* that includes a first number of pixels 106*a* illuminated as a first color (e.g., dark brown) and a second number of pixels 106*b* illuminated as a second color (e.g., light phosphorescent green) that may be different than the first color.

The display device 115 may also render minute tick marks 112, and five minute tick marks 108. The minute tick marks 112 may include a first number of pixels illuminated as a particular color (e.g., dark brown). The five minute tick marks 108 may include a first number of pixels 110*a* illuminated as a first color (e.g., dark brown) and a second number of pixels 110*b* illuminated as a second color (e.g., light phosphorescent green) that may be different than the first color. In certain implementation, the display device 115 may render graphical assets that include calendar graphics 114, pedometer graphics 116, a logo graphics 118, and/or a background 120. Each of the calendar graphics 114, pedometer graphics 116, the logo graphics 118, and the background 120 may include pixels that are illuminated as particular colors in a low light environment. For example, the pixels used to render the calendar graphics 114, the pedometer graphics 116, and the logo graphics may be illuminated as a first color (e.g., dark gray). The background 120 may be illuminated as a second color (e.g., black). In addition, the display device 130 may display the graphical assets at a brightness level that is less than that used to display the graphical assets in FIGS. 1A and 1B.

For example, FIG. 1D depicts a display device 145 in a dark environment. The display device 145 may render graphical assets that include, e.g., a minute hand 102*a* that includes a first number of pixels illuminated as a first color (e.g., dark phosphorescent green). In addition, the graphical assets rendered by the display device 130 may include an hour hand 102*b* that includes a first number of pixels illuminated as a first color (e.g., dark phosphorescent green). The display device 115 may also render five minute tick marks 108. The five minute tick marks 108 may include a first number of pixels illuminated as a first color (e.g., dark phosphorescent green). In certain implementation, the display device 145 may render the remaining pixels black. In addition, the display device 145 may display the graphical assets at a brightness level that may be bright enough to be visible in a dark ambient light environment (e.g., brighter than the graphical assets displayed in FIGS. 1A-1C).

In FIGS. 1A-1D, the display device 100, 115, 130, 145 may determine a first ambient light level based at least in part on the first information received from one or more sensors. In certain implementations, the display device 100, 115, 130, 145 may include one or more light sensors that may be configured to measure ambient light that is incident upon on the light sensor(s) using two or more photodiodes sensitive to different wavelengths of light. The two or more photodiodes may register the incident light, and ambient light levels may be accumulated and averaged over time. The display device 100, 115, 130, 145 may determine a lux (e.g., first ambient light level) incident on the light sensor(s) using the ambient light measurements obtained using the two or more photodiodes. In certain implementations, the determined lux incident may be calibrated by the display device 100, 115, 130, 145 to match human visual light sensitivity. In certain other implementations, the display device 100, 115, 130, 145 may periodically read the average ambient light level, and adjust the gain of the light sensor to avoid saturation.

In certain implementations, the first information may be associated with a plurality of ambient light levels measured over a time period by the one or more sensors. For example, the display device 100, 115, 130, 145 may determine the first ambient light level based at least in part on the first information received from the one or more sensors by determining the first ambient light level as an average of the plurality of ambient light levels over the time period (e.g., one second, five seconds, ten seconds, one minute, five minutes, etc.).

Referring to FIG. 1A, the display device 100 is illustrated in a bright ambient light environment such as a sunny outdoor environment and/or a brightly lit indoor environment. Thus, the display device 100 in FIG. 1A may determine that the lux incident on the light sensor is that of bright ambient light (e.g., by comparing the determined lux to multiple thresholds to determine the ambient light level—bright, dim, low, dark, etc.).

Referring to FIG. 1B, the display device 115 is illustrated in a dim ambient light environment that is less bright than the environment depicted in FIG. 1A. For example, the display device 115 in FIG. 1B may determine that the lux incident on the light sensor is that of dim ambient light (e.g., an office with dim overhead light and with a window).

Referring to FIG. 1C, the display device 130 is illustrated in a low ambient light environment that is less bright than the environment than the environments depicted in FIGS. 1A and 1B. For example, the display device 130 in FIG. 1C may determine that the lux incident on the light sensor is that of low ambient light (e.g., low overhead movie theater lighting).

Referring to FIG. 1D, the display device 145 is illustrated in a dark ambient light environment that is less bright than the environment than the environments depicted in FIGS. 1A-1C. For example, the display device 145 in FIG. 1D may determine that the lux incident on the light sensor is that of a dark environment (e.g., a darkened movie theater).

The display device 100, 115, 130, 145 may generate a first color palette associated with the first ambient light level. In certain implementations, the display device 100, 115, 130, 145 may generate the first color palette associated with the first ambient light level by selecting two or more predetermined color palettes from a plurality of predetermined color palettes (e.g., a first color palette stored for bright light levels, a second color palette stored for dim ambient light levels, a third color palette stored for dark ambient light levels, etc.) based as least in part on the first ambient light level. In certain other implementations, the display device 100, 115, 130, 145 may generate the first color palette associated with the first ambient light level (e.g., see FIGS.

1E and 1F) by interpolating between the two or more predetermined color palettes based on the ambient light level to generate the first color palette.

For example, the display device 100, 115, 130, 145 may use a linear interpolation factor α to select a color palette by applying linear scaling of the light reading to a ratio of the bright office reading. In certain implementations, the display device 100, 115, 130, 145 may map the linear interpolation factor α through different transformations (logarithmic, exponential, polynomials, etc.) to achieve various transition effects (e.g., the transition from a first color palette associate with a bright ambient light level to a second color palette associated with a dim ambient light level).

In certain implementations, the display device 100, 115, 130, 145 may use a color palette to map different colors to different sets of pixels on the display. Referring to FIGS. 1E and 1F, the color palettes 160, 175 may include a mapping of a color index to a certain number of pixels to different colors depending on the determined ambient light level.

For example, different pixels of the same visual color in full light mode may map to a different color in low light mode. In the example images, some white pixels in a bright ambient light environment (e.g., see 112 in FIG. 1A) mode map to black pixels (e.g., see FIG. 1D) in an environment with dark ambient light. The same pixels (e.g., see 112 in FIG. 1C) may map to light phosphorescent green in low light mode. The graphical assets may be palette indexes. Every pixel may have one of the colors of the palette and as the ambient light level changes each pixel may get different colors without redefining all of the assets for every light level. In other words, the display device 100, 115, 130, 145 may maintain the minute tick mark 112 pixels in a watch face dial graphical asset files such that the minute tick mark 112 pixels are represented with different palette indexes associated with different ambient light levels.

Generating graphical assets associated with different color indices may be accomplished, e.g., with the introduction of new colors that otherwise may not appear in the images. For example, pixels intended to be phosphorescent in low light mode may be painted magenta. Pixels intended to be white in full light but fade to black may be painted white. Once the image is palletized, the magenta palette index may be set to white for full light mode and green for low light mode. The white palette index may be set to white in full light mode and black in low light mode.

In certain implementations, the display device 100, 115, 130, 145 may determine a first screen brightness level associated with the first ambient light level. For example, the display device 100, 115, 130, 145 may determine the first screen brightness level by selecting two or more screen brightness levels from a plurality of screen brightness levels based as least in part on the first ambient light level, and interpolating between the two or more screen brightness levels using the first ambient light level to determine the first screen brightness level associated with the first ambient light level.

In certain implementations, the display device 100, 115, 130, 145 may use piecewise linear interpolation to interpolate the screen brightness level. For example, the display device 100, 115, 130, 145 may select the greatest lower bound ambient light level and the smallest upper bound ambient light level, and linearly interpolate between the screen brightness level associated with the greatest lower bound ambient light level and the smallest upper bound ambient light level. In certain aspects, the display device 100, 115, 130, 145 may apply piecewise polynomial interpolation around the nearest k ambient light levels selected based on the determined ambient light level (e.g., spline interpolation). For example, the display device 100, 115, 130, 145 may access a list of items, in which each of the items in list may contain an associated ambient light level, an associated color palette, and an associated screen brightness level. The display device 100, 115, 130, 145 may select the two ambient light levels (e.g., the k ambient light levels) from the list that are closest to the determined ambient light level, and interpolate between the associated screen brightness levels associated with the two selected items to determine the screen brightness level to use in displaying an image.

Allowing brightness to vary together with color palette may enable the display device 100, 115, 130, 145 to increase the visual impact of the phosphorescent effect and reduce power consumption (e.g., by illuminating fewer pixels). For example, in full light, the display device 100 illustrated in FIG. 1A may be put in a moderately bright mode with many lit pixels and graphical assets rendered in full detail. In a dark environment, most of the colors used in the background may be mapped to black. One color representing the phosphorescent paint on the hands and dial may be mapped to a bright green color. The display brightness level may be increased to maximum for a striking glow effect in a dark environment. Because a relatively small number of pixels are illuminated in FIG. 1D, eye strain and distraction caused by others may be reduced.

For some types of AMOLED display, power consumption may be more closely tied to the number of pixels that are illuminated, and less to the brightness level used to illuminate the pixels. In other words, graphical assets displayed with a relatively small number of pixels illuminated (e.g., see FIG. 1D) may be displayed with an increased brightness. When a displayed image includes a larger number of pixels illuminated to display graphical assets (e.g., see FIG. 1C), the display device 115 may decrease the brightness level to moderate power consumption and reproduce a more traditional phosphorescent light level. For example, the watch face in bright ambient light (e.g., the display device 100 illustrated in FIG. 1A) may have, e.g., 9% of pixels illuminated as non-black colors. In a dark ambient light environment, the watch face may have, e.g., 0.86% of the pixels illuminated to render the watch face as non-black color(s). By using a reduced number of pixels in a dark ambient light environment, power savings may be provided even when the screen brightness is increased in the dark ambient light environment.

In certain implementations, the display device 100, 115, 130, 145 may display a first image on a display screen using the first color palette and the first screen brightness level. For example, the display device 100, 115, 130, 145 may receive information associated with one or more first graphical assets (e.g., see 102*a*, 102*b*, 108, 112, 114, 116, 118 in FIG. 1A) associated with the first ambient light level (e.g., a bright ambient light level) and first timekeeping state information, and display the one or more first graphical assets and the timekeeping state information using the first color palette and the first screen brightness level. In one aspect, one or more second graphical assets (e.g., see 104*b*, 106*b*, 110*b* in FIG. 1D) may be associated with a second ambient light level (e.g., a dark environment).

In certain other implementations, a first number of pixels may be mapped to a first color index (e.g., color index a in FIGS. 1E and 1F) in a plurality of color palettes. In one aspect, the first color index may be mapped to the first color (e.g., white) and the first ambient light level (e.g., bright ambient light level). In certain other implementations, a second number of pixels may be mapped to a second color index (e.g., color index b in FIGS. 1E and 1F) in the plurality of color palettes. In one aspect, the second color index may be mapped to the second color (e.g., brown) and the first ambient light level (e.g., bright ambient light level).

Referring to FIG. 1A, the display device 100 may determine that the first ambient light level (e.g., bright ambient light in FIG. 1A) changes to a second ambient light level (e.g., dark ambient light associated with FIG. 1E). The display device 100 may generate a second color palette (e.g., dark ambient light level color palette in FIG. 1E) associated with the second ambient light level (e.g., dim ambient light). The display device 100 may determine a second screen brightness level associated with the second ambient light level (e.g., a screen brightness level used in FIG. 1E is increased as compared to the screen brightness level used to display the graphical assets in FIG. 1A). The display device 145 may display a second image (e.g., graphical assets and/or pixels 104*b*, 106, 110*b* in FIG. 1E) on the display screen based on the second color palette and the second screen brightness level (e.g. display the graphical assets using the dark ambient light level color palette and an increased screen brightness level in FIG. 1E as compared to the screen brightness level used to display the graphical assets in FIG. 1A).

Based on the foregoing, the present disclosure may provide a technique to adapt images displayed on a digital display device to different ambient light levels such that the images are visible to the user, and the potential for eye strain and/or distraction to others in a low ambient light environment is reduced.

FIGS. 2A-2E are a flowchart 200 of a method of adjusting color palettes for a display device based on ambient light levels in accordance with certain aspects of the disclosure. The method may be performed by a display device (e.g., the display device 100, 115, 130, 145, the apparatus 301/301'). In FIGS. 2A-2E, operations indicated with dashed lines represent optional operations for various aspects of the disclosure.

Figure 2A:
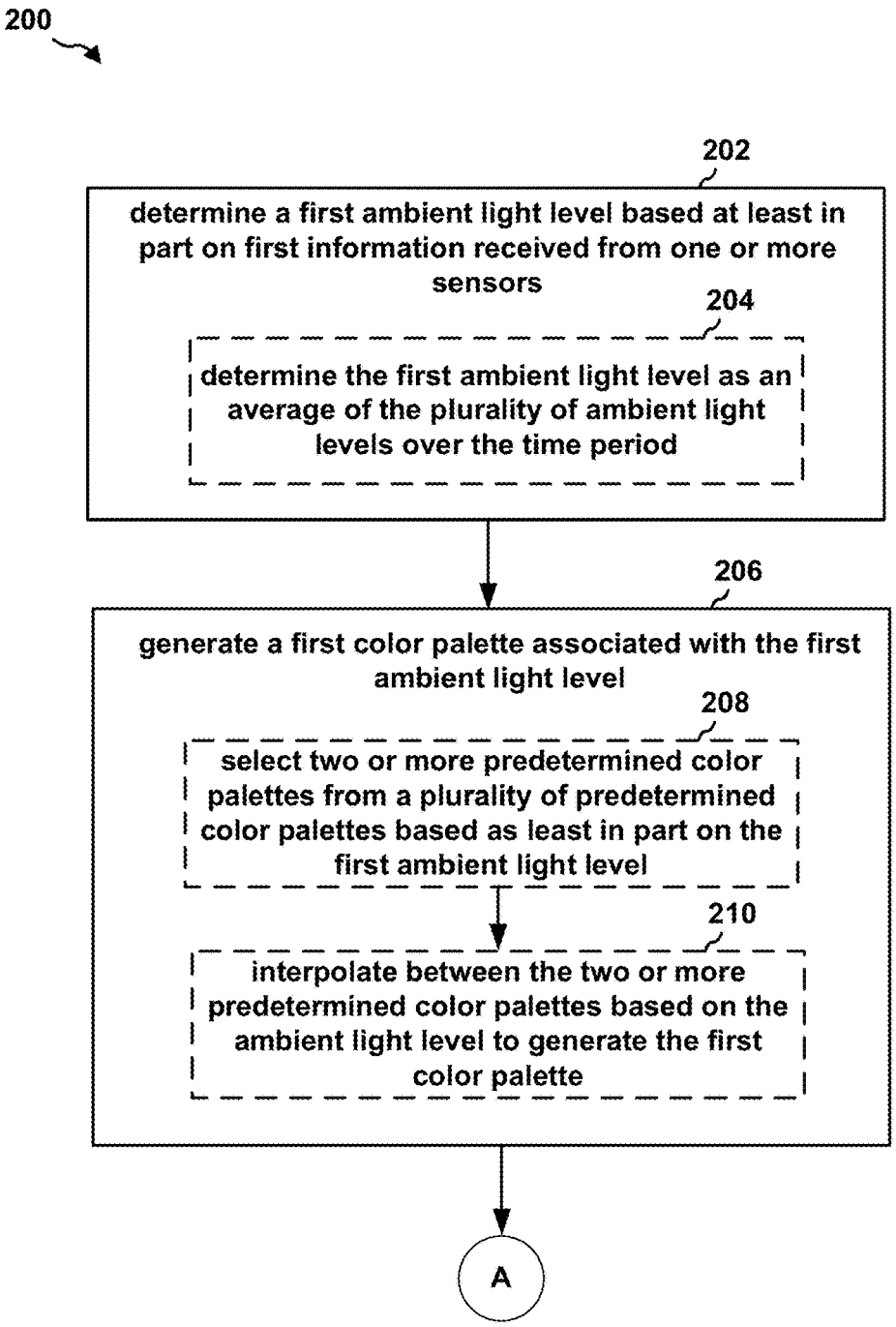
FIGS. 2A-2E are a flowchart of a method of adjusting color palettes used for displaying images on a display device based on ambient light levels in accordance with certain aspects of the disclosure.

In FIG. 2A, at 202, the display device may determine a first ambient light level based at least in part on first information received from one or more sensors. In one aspect, the first information is associated with a plurality of ambient light levels measured over a time period by the one or more sensors. For example, referring to FIGS. 1A-1D, the display device 100, 115, 130, 145 may determine a first ambient light level based at least in part on the first information received from one or more sensors. In certain implementations, the display device 100, 115, 130, 145 may include one or more light sensors that may be configured to measure ambient light that is incident upon on the light sensor(s) using two or more photodiodes sensitive to different wavelengths of light. The two or more photodiodes may register the incident light, and ambient light levels may be accumulated and averaged over time. The display device 100, 115, 130, 145 may determine a lux (e.g., first ambient light level) incident on the light sensor(s) using the ambient light measurements obtained using the two or more photodiodes.

In certain implementations, the determined lux incident may be calibrated by the display device 100, 115, 130, 145 to match human visual light sensitivity. For example, the display device 100, 115, 130, 145 may periodically read the average ambient light level, and adjust the gain of the light sensor to avoid saturation. In certain implementations, the first information may be associated with a plurality of ambient light levels measured over a time period by the one or more sensors. For example, the display device 100, 115, 130, 145 may determine the first ambient light level based at least in part on the first information received from the one or more sensors by determining the first ambient light level as an average of the plurality of ambient light levels over the time period (e.g., 1 sec.).

At 204, the display device may determine the first ambient light level based at least in part on the first information received from the one or more sensors by determining the first ambient light level as an average of the plurality of ambient light levels over the time period. For example, referring to FIGS. 1A-1D, the first information may be associated with a plurality of ambient light levels measured over a time period by the one or more sensors. For example, the display device 100, 115, 130, 145 may determine the first ambient light level based at least in part on the first information received from the one or more sensors by determining the first ambient light level as an average of the plurality of ambient light levels over the time period.

At 206, the display device may generate a first color palette associated with the first ambient light level. In one aspect, each of the plurality of predetermined color palettes may be associated with a different ambient light level. In another aspect, the two or more predetermined color palettes selected from the plurality of predetermined color palettes may be associated with ambient light levels that are closest to the first ambient light level. For example, referring to FIGS. 1A-1F, the display device 100, 115, 130, 145 may generate a first color palette associated with the first ambient light level by selecting the color palette that is associated with an ambient light level closest to the current or first ambient light level. In certain implementations, the display device 100, 115, 130, 145 may generate the first color palette associated with the first ambient light level by selecting two or more predetermined color palettes from a plurality of predetermined color palettes (e.g., a first color palette maintained for bright light levels, a second color palette maintained for dim ambient light levels, a third color palette maintained for dark ambient light levels, etc.) based as least in part on the first ambient light level.

In certain other implementations, the display device 100, 115, 130, 145 may generate the first color palette associated with the first ambient light level (e.g., see FIGS. 1E and 1F) by interpolating between the two or more predetermined color palettes based on the ambient light level to generate the first color palette. The display device 100, 115, 130, 145 may use a linear interpolation factor $\alpha$ to select a color palette by applying linear scaling of a measured ambient light level to a ratio of the bright office reading. In certain implementations, the display device 100, 115, 130, 145 may map the linear interpolation factor $\alpha$ through different transformations (logarithmic, exponential, polynomials, etc.) to achieve various transition effects (e.g., the transition from a first color palette associated with a bright ambient light level to a second color palette associated with a dim ambient light level). In certain implementations, the display device 100, 115, 130, 145 may use a color palette to map different colors to different sets of pixels on the display. Referring to FIGS. 1E and 1F, the color palettes 160, 175 may include a mapping of a color index to a certain number of pixels to different colors depending on the determined ambient light level.

At 208, the display device may generate the first color palette associated with the first ambient light level by selecting two or more predetermined color palettes from a plurality of predetermined color palettes based as least in part on the first ambient light level. For example, referring to FIGS. 1A-1D, the display device 100, 115, 130, 145 may generate the first color palette associated with the first ambient light level by selecting two or more predetermined color palettes from a plurality of predetermined color palettes (e.g., a first color palette maintained for bright light levels, a second color palette maintained for dim ambient light levels, a third color palette for low ambient light levels, and a fourth color palette maintained for dark ambient light levels, etc.) based as least in part on the first ambient light level. In certain implementations, the display device 100, 115, 130, 145 may select the two closest color palettes (e.g., P and Q) associated with the determined ambient light level. In some aspects, the display device may generate the first color palette based on processing capabilities of the display device. The processing capabilities may, for example, comprise the speed of the of the processor or amount of memory or other aspects of the hardware configuration of the display device.

At 210, the display device may generate the first color palette associated with the first ambient light level by interpolating between the two or more predetermined color palettes based on the ambient light level to generate the first color palette. For example, referring to FIGS. 1A-1F, the display device 100, 115, 130, 145 may use a linear interpolation factor $\alpha$ to select a color palette by applying linear scaling of the light reading to a ratio of the bright office reading.

In certain implementations, the display device 100, 115, 130, 145 may map the linear interpolation factor $\alpha$ (e.g., $\alpha=0$ is associated with the first color palette maintained by the display device, $\alpha=1$ is associated with a second color palette maintained by the display device, etc.) through different transformations (logarithmic, exponential, polynomials, etc.) to achieve various transition effects (e.g., the transition from a first color palette associate with a bright ambient light level to a second color palette associated with a dim ambient light level). For each color index i in the color palettes and for each channel c (e.g., red (R), green (G), and blue (B)), the display device 100, 115, 130, 145 may interpolate the color channel using $R_ic=lerp(P_ic\hat{}\gamma,\ Q_ic\hat{}\gamma,\ \alpha)\hat{}(1/\gamma)$, where $\gamma$ is a parameter that may be used to determine a non-linear mapping between intensity encoding and light intensity. In certain implementations, $\gamma$ may be a property of the display screen. For example, certain display screens may have a $\gamma=2.2$. In certain other implementations, the display device 100, 115, 130, 145 may select the closest representable color from the color space that matches the interpolated color space. That is, given a fixed number of bits used to represent colors, there may only a finite number of representable colors. For example, in RGB332 color space there are only 256 possible colors. Mixing two colors may create a color that has RGB components that are real numbers rather than precise binary numbers matching the possible values. Selecting the "closest" or "best" color that most proximally matches the mixed color involves designing a metric for how "different" two colors are. Accordingly, selecting the closest representable color may then include a process of picking one of the 256 possible colors (e.g., if we are in RGB332 color space) with the smallest difference. In some aspects, an error may be added in each color channel. Further, in some aspects, a weighting factor may be applied to each color channel such that G has the most weight, R the next highest, and B the least because the eye may be most sensitive to green differences and less to red and blue.

In certain implementations, the display device 100, 115, 130, 145 may use non-linear interpolation by applying a transformation (e.g., logarithmic, exponential, polynomials, etc.) in order to adjust the curve between two far away palettes (e.g., the first color palette associated with bright light and the fourth color palette associated with a dark environment). Linear interpolation between the first color palette and the fourth color palette may not provide a smooth transition of the graphical assets when a user moves from a brightly lit environment to a dark environment. In order to provide a smooth transition, the display device 100, 115, 130, 145 may maintain intermediate color palettes (e.g., a second color palette maintained for dim ambient light levels and a third color palette for low ambient light levels). In certain aspects, the interpolation using $\alpha$ may transition from 0 to 1 linearly and smoothly, and is 0.5 halfway along of the curve. In certain other aspects, the interpolation using $\alpha\hat{}2$ may transition from 0 to 1 smoothly, and is 0.25 halfway along of the curve, change more slowly on the left side of the curve when $\alpha<0.5$, and change more quickly on the right side of the curve when $\alpha>0.5$. In certain other aspect, the interpolation using $\alpha\hat{}0.5$ may transition from 0 to 1 smoothly, and may be 0.71 halfway along the curve, change more slowly on the right side of the curve, and change more quickly on the left side of the curve.

Figure 2B:
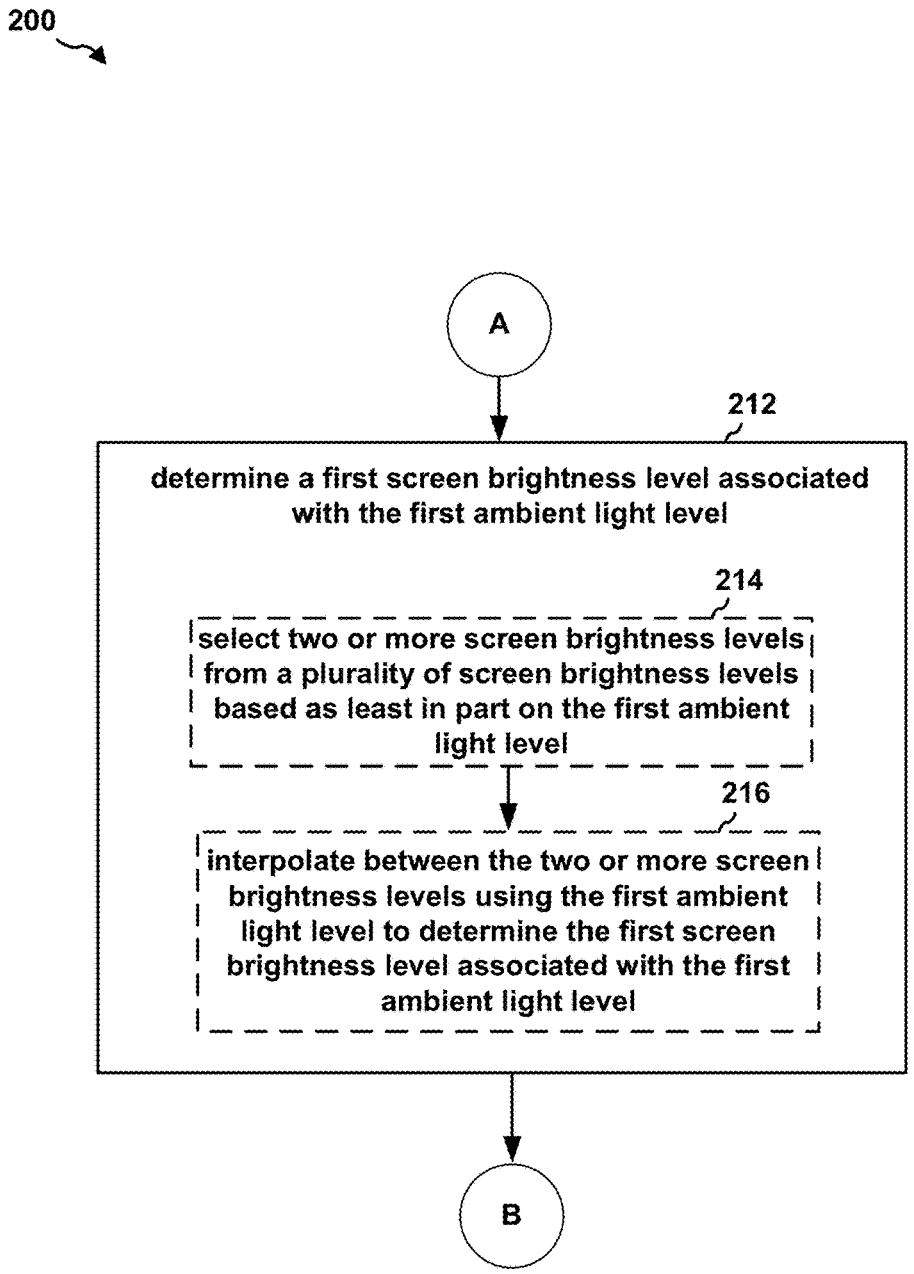

Referring to FIG. 2B, at 212, the display device may determine a first screen brightness level associated with the first ambient light level. For example, referring to FIGS. 1A-1D, the display device 100, 115, 130, 145 may determine a first screen brightness level associated with the first ambient light level. Allowing brightness to vary together with color palette may enable the display device 100, 115, 130, 145 to increase the visual impact of the phosphorescent effect and make a tradeoff with power consumption. For example, in full light, the display device 100 illustrated in FIG. 1A may be put in a moderately bright mode with many lit pixels and graphical assets rendered in full detail. In a dark environment, most of the colors used in the background may be mapped to black. One color representing the phosphorescent paint on the hands and dial may be mapped to a bright green color. The display brightness level may be increased to maximum for a striking glow effect in a dark environment. Because a relatively small number of pixels are illuminated in FIG. 1D, eye strain and distraction caused by others may be minimized.

At 214, the display device may determine the first screen brightness level associated with the first ambient light level by selecting two or more screen brightness levels from a plurality of screen brightness levels based as least in part on the first ambient light level. For example, referring to FIGS. 1A-1D, the display device 100, 115, 130, 145 may determine the first screen brightness level by selecting two or more screen brightness levels from a plurality of screen brightness levels based as least in part on the first ambient light level.

At 216, the display device may determine the first screen brightness level associated with the first ambient light level by interpolating between the two or more screen brightness levels using the first ambient light level to determine the first screen brightness level associated with the first ambient light level. For example, referring to FIGS. 1A-1D, the display device 100, 115, 130, 145 may determine the first screen brightness level by interpolating between the two or more screen brightness levels using the first ambient light level to determine the first screen brightness level associated with the first ambient light level.

Figure 2C:
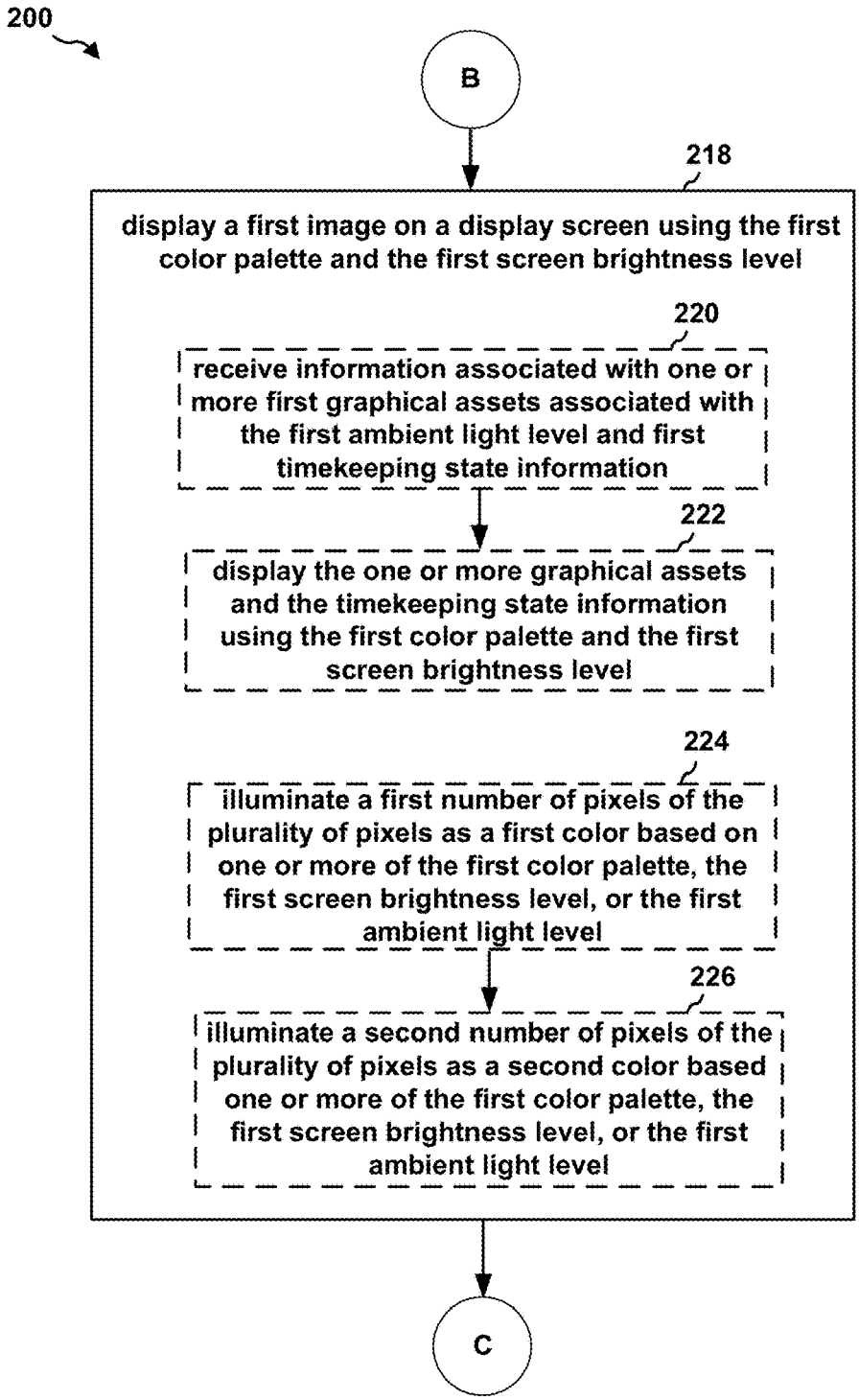

Referring to FIG. 2C, at 218, the display device may display a first image on a display screen using the first color palette and the first screen brightness level. In one aspect, the display screen may include a plurality of pixels. For example, referring to FIG. 1A, the display device 100 may render graphical assets that include, e.g., a minute hand 102*a* that includes a first number of pixels 104*a* illuminated as a first color (e.g., taupe) and a second number of pixels 104*b* illuminated as a second color (e.g., white) that may be different than the first color. In addition, the graphical assets rendered by the display device 100 may include an hour hand 102*b* that includes a first number of pixels 106*a* illuminated as a first color (e.g., taupe) and a second number of pixels 106*b* illuminated as a second color (e.g., white) that may be different than the first color. The display device 100 may also render minute tick marks 112, and five minute tick marks 108. The minute tick marks 112 may include a first number of pixels illuminated as a particular color (e.g., white). The five minute tick marks 108 may include a first number of pixels 110*a* illuminated as a first color (e.g., taupe) and a second number of pixels 110*b* illuminated as a second color (e.g., white) that may be different than the first color.

In certain implementation, the display device 100 may render graphical assets that include calendar graphics 114, pedometer graphics 116, a logo graphics 118, and/or a background 120. Each of the calendar graphics 114, pedometer graphics 116, the logo graphics 118, and the background 120 may include pixels that are illuminated as particular colors in a bright light environment. For example, the pixels used to render the calendar graphics 114, the pedometer graphics 116, and the logo graphics 118 may be illuminated as a first color (e.g., taupe). The background 120 may be illuminated as a second color (e.g., black). In addition, the display device 100 may display the graphical assets at a brightness level that may be bright enough to be visible in a bright ambient light environment.

At 220, the display device may display a first image on a display screen using the first color palette and the first screen brightness level based on received information associated with one or more first graphical assets associated with the first ambient light level and first timekeeping state information. For example, referring to FIG. 1A, the display device 100, 115, 130, 145 may receive information (e.g., pixel location, images of the graphical assets, how and when the graphical assets change position, etc.) associated with one or more first graphical assets (e.g., see 102*a*, 102*b*, 108, 112, 114, 116, 118 in FIG. 1A) associated with the first ambient light level and first timekeeping state information.

At 222, the display device may display the first image on a display screen using the first color palette and the first screen brightness level by displaying the one or more graphical assets and the timekeeping state information using the first color palette and the first screen brightness level. In one aspect, one or more second graphical assets may be associated with a second ambient light level. In another aspect, the second ambient light level may be different than the first ambient light level. In a further aspect, the one or more second graphical assets include at least one different graphical asset than the one or more first graphical assets. For example, referring to FIGS. 1A and 1B, display the one or more first graphical assets (e.g., see 102*a*, 102*b*, 108, 112, 114, 116, 118 in FIG. 1A) and the timekeeping state information using the first color palette and the first screen brightness level.

At 224, the display device may display the first image on a display screen using the first color palette and the first screen brightness level by illuminating a first number of pixels of the plurality of pixels as a first color based on one or more of the first color palette, the first screen brightness level, or the first ambient light level. In one aspect, the first number of pixels may be mapped to a first color index in a plurality of color palettes. In another aspect, the first color index may be mapped to the first color and the first ambient light level. In certain other aspect, the first color index may be mapped to a non-black color at the first ambient light level. For example, referring to FIG. 1A, the display device 100 may render graphical assets that include, e.g., a minute hand 102*a* that includes a first number of pixels 104*a* illuminated as a first color (e.g., taupe) and a second number of pixels 104*b* illuminated as a second color (e.g., white) that may be different than the first color.

In addition, the graphical assets rendered by the display device 100 may include an hour hand 102*b* that includes a first number of pixels 106*a* illuminated as a first color (e.g., taupe) and a second number of pixels 106*b* illuminated as a second color (e.g., white) that may be different than the first color. The display device 100 may also render minute tick marks 112, and five minute tick marks 108. The minute tick marks 112 may include a first number of pixels illuminated as a particular color (e.g., white). The five minute tick marks 108 may include a first number of pixels 110*a* illuminated as a first color (e.g., taupe) and a second number of pixels 110*b* illuminated as a second color (e.g., white) that may be different than the first color.

In certain implementation, the display device 100 may render graphical assets that include calendar graphics 114, pedometer graphics 116, a logo graphics 118, and/or a background 120. Each of the calendar graphics 114, pedometer graphics 116, the logo graphics 118, and the background 120 may include pixels that are illuminated as particular colors in a bright light environment. For example, the pixels used to render the calendar graphics 114, the pedometer graphics 116, and the logo graphics 118 may be illuminated as a first color (e.g., taupe). The background 120 may be illuminated as a second color (e.g., black). In addition, the display device 100 may display the graphical assets at a brightness level that may be bright enough to be visible in a bright ambient light environment.

At 226, the display device may display the first image on a display screen using the first color palette and the first screen brightness level by illuminating a second number of pixels of the plurality of pixels as a second color based one or more of the first color palette, the first screen brightness level, or the first ambient light level. In one aspect, the second number of pixels is mapped to a second color index in the plurality of color palettes. In another aspect, the second color index may be mapped to the second color and the first ambient light level. In certain other aspects, the first color index may be mapped to a black color at a second ambient light level. For example, referring to FIG. 1A, the display device 100 may render graphical assets that include, e.g., a minute hand 102*a* that includes a first number of pixels 104*a* illuminated as a first color (e.g., taupe) and a second number of pixels 104*b* illuminated as a second color (e.g., white) that may be different than the first color.

In addition, the graphical assets rendered by the display device 100 may include an hour hand 102*b* that includes a first number of pixels 106*a* illuminated as a first color (e.g., taupe) and a second number of pixels 106*b* illuminated as a second color (e.g., white) that may be different than the first color. The display device 100 may also render minute tick marks 112, and five minute tick marks 108. The minute tick marks 112 may include a first number of pixels illuminated as a particular color (e.g., white). The five minute tick marks 108 may include a first number of pixels 110*a* illuminated as a first color (e.g., taupe) and a second number of pixels 110*b* illuminated as a second color (e.g., white) that may be different than the first color.

In certain implementation, the display device 100 may render graphical assets that include calendar graphics 114, pedometer graphics 116, a logo graphics 118, and/or a background 120. Each of the calendar graphics 114, pedometer graphics 116, the logo graphics 118, and the background 120 may include pixels that are illuminated as particular colors in a bright light environment. For example, the pixels used to render the calendar graphics 114, the pedometer graphics 116, and the logo graphics 118 may be illuminated as a first color (e.g., taupe). The background 120 may be illuminated as a second color (e.g., black). In addition, the display device 100 may display the graphical assets at a brightness level that may be bright enough to be visible in a bright ambient light environment.

Figure 2D:
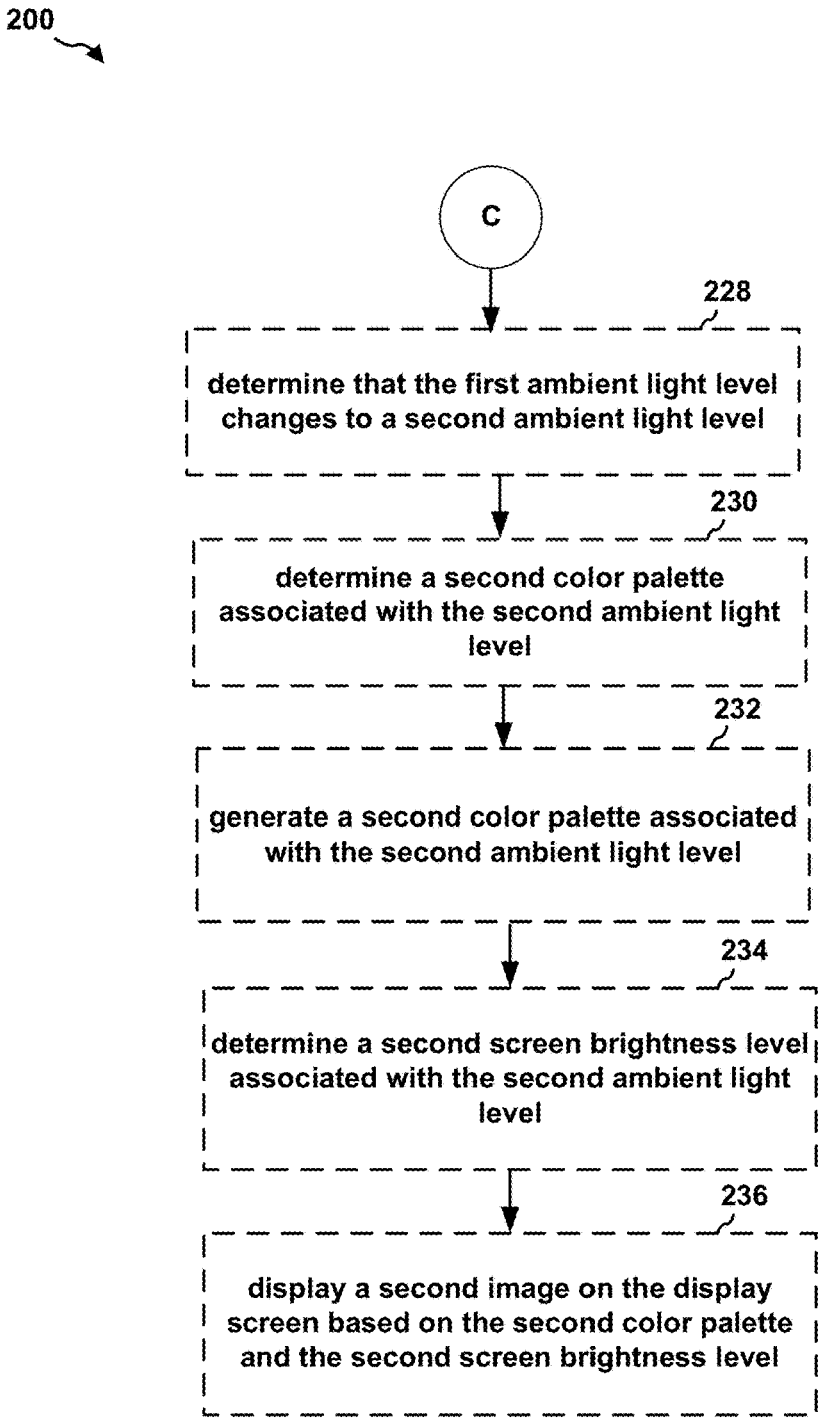

Referring to FIG. 2D, at 228, the display device may determine that the first ambient light level changes to a second ambient light level. For example, referring to FIGS. 1A and 1E, the display device 100 may determine that the first ambient light level (e.g., bright ambient light associated with FIG. 1A) changes to a second ambient light level (e.g., dark ambient light associated with FIG. 1E). The ambient light level may be monitored using sensors (e.g., sensor 304). The second ambient light level may be compared with a previously determined ambient light level to determine that the ambient light level has changed. In some aspects, the second ambient light level may be compared with a previously determined ambient light level plus a change threshold. By adding the delta, changes in the display of graphical asset due to minimal ambient light changes may be reduced.

At 230, the display device may generate a second color palette associated with the second ambient light level. For example, referring to FIGS. 1A and 1E, the display device 100 may generate a second color palette (e.g., dark ambient light level color palette in FIG. 1E) associated with the second ambient light level (e.g., dark ambient light) in a manner similar to that for generating the first color palette described above.

At 232, the display device may determine a second screen brightness level associated with the second ambient light level. For example, referring to FIGS. 1A and 1E, the display device 100 may determine a second screen brightness level associated with the second ambient light level (e.g., a screen brightness level used in FIG. 1E is increased as compared to the screen brightness level used to display the graphical assets in FIG. 1A).

At 234, the display device may display a second image on the display screen based on the second color palette and the second screen brightness level. For example, referring to FIG. 1D, the display device 145 may display a second image (e.g., graphical assets and/or pixels 104*b*, 106, 110*b* in FIG. 1E) on the display screen based on the second color palette and the second screen brightness level (e.g. display the graphical assets using the dim ambient light level color palette and an increased screen brightness level in FIG. 1E as compared to the screen brightness level used to display the graphical assets in FIG. 1A).

Figure 2E:
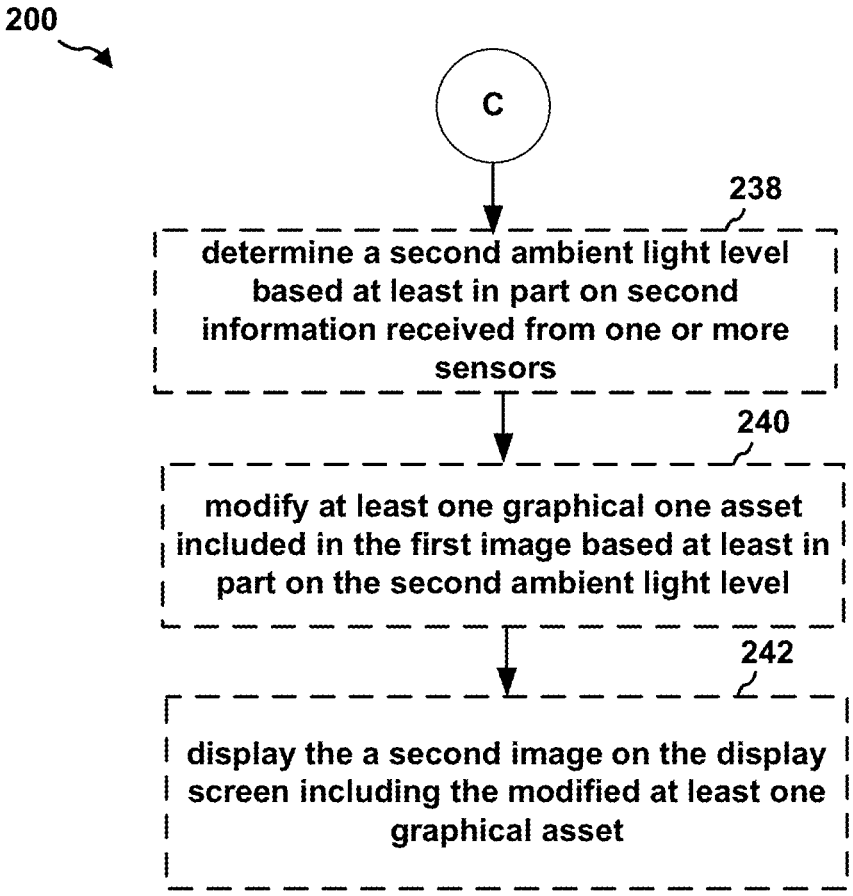

Referring to FIG. 2E, at 238, the display device may determine a second ambient light level based at least in part on second information received from one or more sensors. For example, referring to FIG. 3 ambient light sensor 304 may detect a change in the ambient light 302 from a first level to a second level.

At 240, the display device may modify at least one graphical one asset included in the first image based at least in part on the second ambient light level. For example, referring to FIGS. 1A and 1E, the display device 100 may change the layout of the graphical assets. In one example, the layout of graphical assets displayed on display device 100 may be changed such that the position of the pedometer graphic 116 may be swapped with the logo graphic 118 when the second ambient light level indicates that it is night time (e.g., to indicate to a user that it is time to exercise). In another example, the layout may be modified to replace the logo graphic 118 with an image of the moon (not shown) when the second ambient light level indicates that it is night time or an image of the sun when the second ambient light level indicates that it is day time. In a further example, the size of the graphical assets (e.g., minute hands) may be changed. In some aspects, the modifying may comprise adding or removing graphical asset.

At 242, the display device may display a second image on the display screen including the modified at least one graphical asset.

Figure 3:
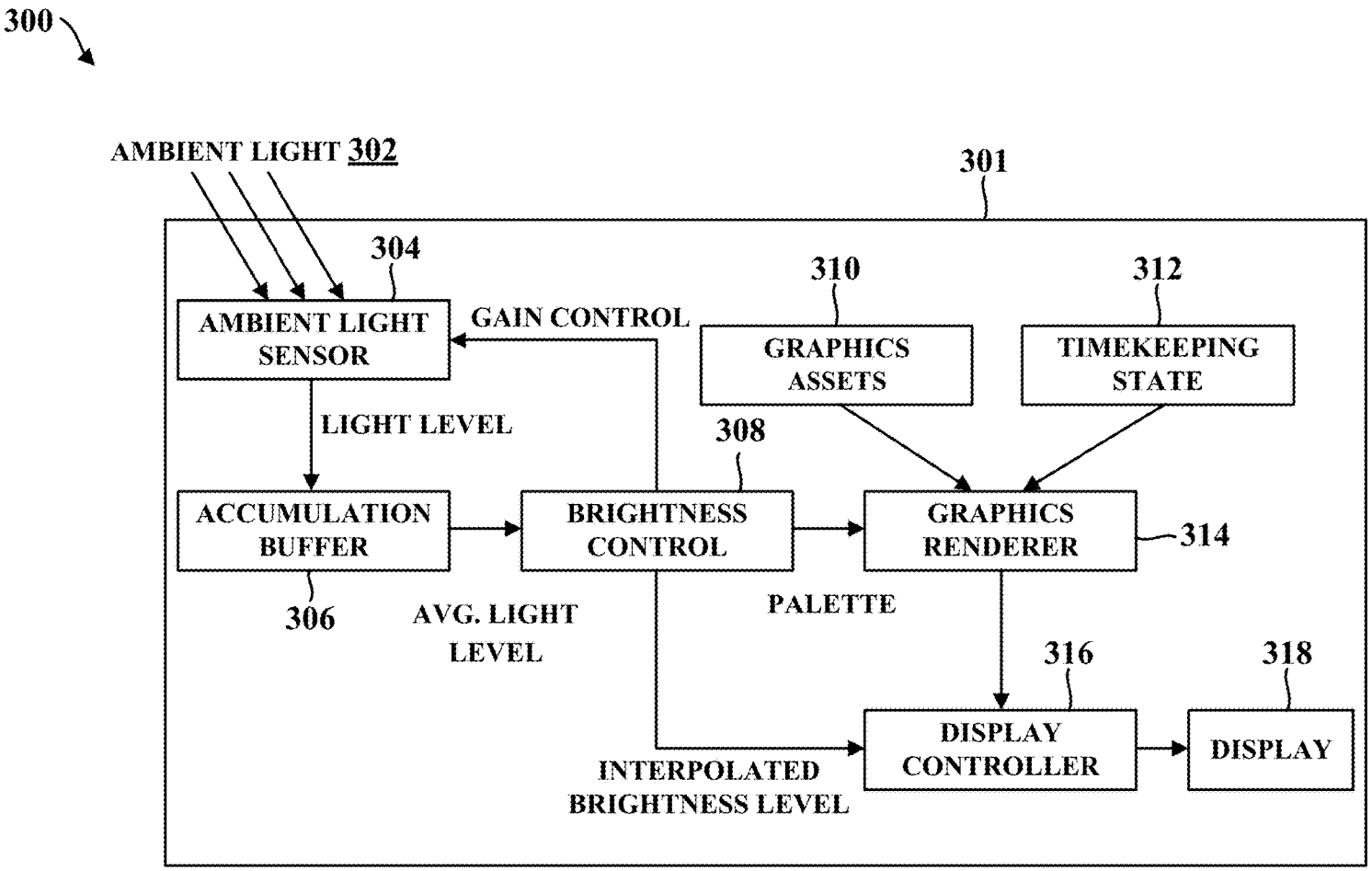
FIG. 3 is a conceptual data flow diagram illustrating the data flow between different means/components in an exemplary apparatus.

FIG. 3 is a conceptual data flow diagram 300 illustrating the data flow between different means/components in an exemplary apparatus 301. The apparatus may be a display device (e.g., the display device 100, 115, 130, 145, the apparatus 301'). The apparatus 301 may include an ambient light sensor component 304, an accumulation buffer component 306, a brightness control component 308, a graphics assets component 310, a timekeeping state component 312, a graphics renderer component 314, a display controller component 316, and a display component 318. Ambient light 302 may impinge on the ambient light sensor component 304. The ambient light sensor component 304 may measure the ambient light level using one or more photodiodes located in the ambient light sensor component 304. The ambient light sensor component 304 may send a signal associated with the measured ambient light level to the accumulation buffer component 306. The accumulation buffer component 306 may determine a first ambient light level based at least in part on first information received from one or more sensors. In one aspect, the first information is associated with a plurality of ambient light levels measured over a time period by the one or more sensors.

The accumulation buffer component 306 may determine the first ambient light level based at least in part on first information received from the one or more sensors by determining the first ambient light level as an average of the plurality of ambient light levels over the time period. The accumulation buffer component 306 may send a signal associated with the determined average ambient light level to the brightness control component 308. The brightness control component 308 may calibrate the determined ambient light level to match human visual light sensitivity, and send a signal associated with gain control (e.g., calibration information) to the ambient light sensor component 304. In addition, the brightness control component 308 may generate a first color palette associated with the first ambient light level.

In one aspect, each of the plurality of predetermined color palettes may be associated with a different ambient light level. In another aspect, the two or more predetermined color palettes selected from the plurality of predetermined color palettes may be associated with ambient light levels that are closest to the first ambient light level. For example, the brightness control component 308 may generate the first color palette associated with the first ambient light level by selecting two or more predetermined color palettes from a plurality of predetermined color palettes based as least in part on the first ambient light level. The brightness control component 308 may also generate the first color palette associated with the first ambient light level by interpolating between the two or more predetermined color palettes based on the ambient light level to generate the first color palette. In addition, the brightness control component 308 may send a signal associated with the generated first color palette to the graphics renderer component 314. The brightness control component 308 may determine a first screen brightness level associated with the first ambient light level. For example, the brightness control component 308 may determine the first screen brightness level associated with the first ambient light level by selecting two or more screen brightness levels from a plurality of screen brightness levels based as least in part on the first ambient light level. In addition, the brightness control component 308 may determine the first screen brightness level associated with the first ambient light level by interpolating between the two or more screen brightness levels using the first ambient light level to determine the first screen brightness level associated with the first ambient light level. The brightness control component 308 may send a signal associated with the interpolated screen brightness level to the display controller component 316.

In certain implementations, the graphics assets component 310 may maintain graphical assets associated with the display device (e.g., the graphical assets discussed supra with respect to FIGS. 1A-1D). The graphics assets component 310 may send a signal associated with the graphical assets to the graphics renderer component 314. The timekeeping state component 312 may maintain and keep track of information associated with the date and time. The timekeeping state component 312 may send a signal associated with timekeeping information and/or date information to the graphics renderer component 314. The graphics renderer component 314 may render an image in a frame buffer using the information associated with the graphical assets, the timekeeping information, the calendar information, and the interpolated color palette. The graphics renderer component 314 may send a signal associated with the rendered frame buffer to a display controller component 316. The display controller component 316 may send a signal associated with the determined screen brightness level and rendered frame buffer to the display component 318. The display component 318 may display a first image on a display screen using the first color palette and the first screen brightness level. In one aspect, the display screen may include a plurality of pixels. For example, the display component 318 may display a first image on a display screen using the first color palette and the first screen brightness level by receiving information (e.g., from the display controller component 316) associated with one or more first graphical assets associated with the first ambient light level and first timekeeping state information. The display component 318 may display the first image on a display screen using the first color palette and the first screen brightness level by displaying the one or more graphical assets and the timekeeping state information using the first color palette and the first screen brightness level.

In one aspect, one or more second graphical assets may be associated with a second ambient light level. In another aspect, the second ambient light level may be different than the first ambient light level. In a further aspect, the one or more second graphical assets include at least one different graphical asset than the one or more first graphical assets. The display component 318 may display the first image on a display screen using the first color palette and the first screen brightness level by illuminating a first number of pixels of the plurality of pixels as a first color based on one or more of the first color palette, the first screen brightness level, or the first ambient light level. In one aspect, the first number of pixels may be mapped to a first color index in a plurality of color palettes. In another aspect, the first color index may be mapped to the first color and the first ambient light level. In certain other aspects, the first color index may be mapped to a non-black color at the first ambient light level. The display component 318 may display the first image on a display screen using the first color palette and the first screen brightness level by illuminating a second number of pixels of the plurality of pixels as a second color based one or more of the first color palette, the first screen brightness level, or the first ambient light level. In one aspect, the second number of pixels is mapped to a second color index in the plurality of color palettes. In another aspect, the second color index may be mapped to the second color and the first ambient light level.

In certain other aspects, the first color index may be mapped to a black color at a second ambient light level. The accumulation buffer component 306 may determine that the first ambient light level changes to a second ambient light level. The accumulation buffer component 306 may send a signal associated with the second ambient light level to brightness control component 308. The brightness control component 308 may generate a second color palette associated with the second ambient light level. The brightness control component 308 may determine a second screen brightness level associated with the second ambient light level. The brightness control component 308 may send a signal associated with the second screen brightness level to the display controller component 316. Using the second color palette, graphical asset information received from the graphics assets component 310 and timekeeping and/or calendar information from the timekeeping state information, the graphics renderer component 314 may render a second image in a frame buffer. The graphics renderer component 314 may send a signal associated with the second image rendered in the frame buffer to display controller component 316. The display controller component 316 may send a signal associated with the second screen brightness level and the second image to the display component 318. The display component 318 may send a second image on the display screen based on the second color palette and the second screen brightness level.

The apparatus may include additional components that perform each of the blocks of the algorithm in the aforementioned flowcharts of FIGS. 2A-2D. As such, each block in the aforementioned flowcharts of FIGS. 2A-2D may be performed by a component and the apparatus may include one or more of those components. The components may be one or more hardware components specifically configured to carry out the stated processes/algorithm, implemented by a processor configured to perform the stated processes/algorithm, stored within a computer-readable medium for implementation by a processor, or some combination thereof.

Figure 4:
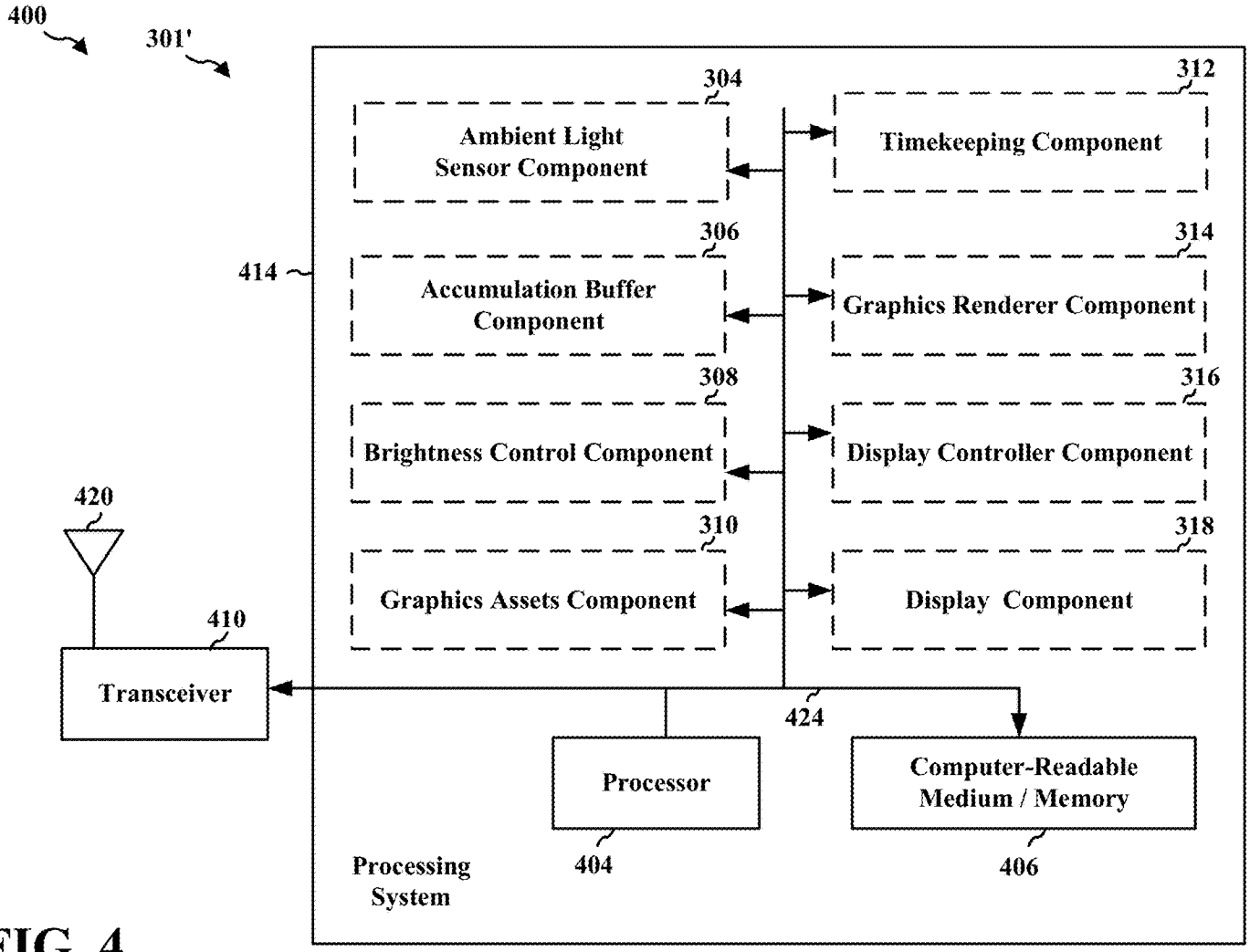
FIG. 4 is a diagram illustrating an example of a hardware implementation for an apparatus employing a processing system.

FIG. 4 is a diagram 400 illustrating an example of a hardware implementation for an apparatus 301' employing a processing system 414. The processing system 414 may be implemented with a bus architecture, represented generally by the bus 424. The bus 424 may include any number of interconnecting buses and bridges depending on the specific application of the processing system 414 and the overall design constraints. The bus 424 links together various circuits including one or more processors and/or hardware components, represented by the processor 404, the components 304, 306, 308, 310, 312, 314, 316, 318 and the computer-readable medium/memory 406. The bus 424 may also link various other circuits such as timing sources, peripherals, voltage regulators, and power management circuits, which are well known in the art, and therefore, will not be described any further.

The processing system 414 may be coupled to a transceiver 410. The transceiver 410 is coupled to one or more antennas 420. The transceiver 410 provides a means for communicating with various other apparatus over a transmission medium. The transceiver 410 receives a signal from the one or more antennas 420, extracts information from the received signal, and provides the extracted information to the processing system 414. In addition, the transceiver 410 receives information from the processing system 414, and based on the received information, generates a signal to be applied to the one or more antennas 420. The processing system 414 includes a processor 404 coupled to a computer-readable medium/memory 406. The processor 404 is responsible for general processing, including the execution of software stored on the computer-readable medium/memory 406. The software, when executed by the processor 404, causes the processing system 414 to perform the various functions described supra for any particular apparatus. The computer-readable medium/memory 406 may also be used for storing data that is manipulated by the processor 404 when executing software. The processing system 414 further includes at least one of the components 304, 306, 308, 310, 312, 314, 316, 318. The components may be software components running in the processor 404, resident/stored in the computer readable medium/memory 406, one or more hardware components coupled to the processor 404, or some combination thereof.

In one configuration, the display device 301/301' may include means for determining a first ambient light level based at least in part on first information received from one or more sensors. In one aspect, the first information is associated with a plurality of ambient light levels measured over a time period by the one or more sensors. For example, the means for determining the first ambient light level based at least in part on the first information received from the one or more sensors may be configured to determine the first ambient light level as an average of the plurality of ambient light levels over the time period. In certain other configurations, the display device 301/301' may include means for generating a first color palette associated with the first ambient light level. In one aspect, each of the plurality of predetermined color palettes may be associated with a different ambient light level. In another aspect, the two or more predetermined color palettes selected from the plurality of predetermined color palettes may be associated with ambient light levels that are closest to the first ambient light level. For example, the means for generating the first color palette associated with the first ambient light level may be configured to select two or more predetermined color palettes from a plurality of predetermined color palettes based as least in part on the first ambient light level. The means for generating the first color palette associated with the first ambient light level may be configured to interpolate between the two or more predetermined color palettes based on the ambient light level to generate the first color palette.

In certain other configurations, the display device 301/301' may include means for determining a first screen brightness level associated with the first ambient light level. For example, the means for determining the first screen brightness level associated with the first ambient light level may be configured to select two or more screen brightness levels from a plurality of screen brightness levels based as least in part on the first ambient light level. The means for determining the first screen brightness level associated with the first ambient light level may be configured to interpolate between the two or more screen brightness levels using the first ambient light level to determine the first screen brightness level associated with the first ambient light level. In certain other configurations, the display device 301/301' may include means for displaying a first image on a display screen using the first color palette and the first screen brightness level. In one aspect, the display screen may include a plurality of pixels. For example, the means for displaying the first image on a display screen using the first color palette and the first screen brightness level may be configured to receive information associated with one or more first graphical assets associated with the first ambient light level and first timekeeping state information. The means for displaying the first image on a display screen using the first color palette and the first screen brightness level may be configured to display the one or more graphical assets and the timekeeping state information using the first color palette and the first screen brightness level. The means for displaying the first image on a display screen using the first color palette and the first screen brightness level may be configured to illuminate a first number of pixels of the plurality of pixels as a first color based on one or more of the first color palette, the first screen brightness level, or the first ambient light level. In one aspect, the first number of pixels may be mapped to a first color index in a plurality of color palettes. In another aspect, the first color index may be mapped to the first color and the first ambient light level. In certain other aspect, the first color index may be mapped to a non-black color at the first ambient light level. The means for displaying the first image on a display screen using the first color palette and the first screen brightness level may be configured to illuminate a second number of pixels of the plurality of pixels as a second color based one or more of the first color palette, the first screen brightness level, or the first ambient light level. In one aspect, the second number of pixels is mapped to a second color index in the plurality of color palettes. In another aspect, the second color index may be mapped to the second color and the first ambient light level. In certain other aspects, the first color index may be mapped to a black color at a second ambient light level. In certain other configurations, the display device 301/301' may include means for determining that the first ambient light level changes to a second ambient light level. In certain other configurations, the display device 301/301' may include means for generating a second color palette associated with the second ambient light level. In certain other configurations, the display device 301/301' may include means for determining for a second screen brightness level associated with the second ambient light level. In certain other configurations, the display device 301/301' may include means for displaying a second image on the display screen based on the second color palette and the second screen brightness level.

The aforementioned means may be one or more of the aforementioned components of the apparatus 301 and/or the processing system 414 of the apparatus 301' configured to perform the functions recited by the aforementioned means.

It is understood that the specific order or hierarchy of blocks in the processes/flowcharts disclosed is an illustration of exemplary approaches. Based upon design preferences, it is understood that the specific order or hierarchy of blocks in the processes/flowcharts may be rearranged. Further, some blocks may be combined or omitted. The accompanying method claims present elements of the various blocks in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

What is claimed is:

1. A method of adjusting color palettes for a display device based on ambient light levels, comprising:

determining a first ambient light level based at least in part on first information received from one or more sensors;

generating a first color palette associated with the first ambient light level;

determining a first screen brightness level associated with the first ambient light level; and displaying a first image on a display screen using the first color palette and the first screen brightness level, wherein the displaying the first image on the display screen using the first color palette and the first screen brightness level comprises:

receiving information associated with one or more first graphical assets associated with the first ambient light level and timekeeping state information; and displaying the one or more first graphical assets and the timekeeping state information using the first color palette and the first screen brightness level.

2. The method of claim 1, wherein the first information is associated with a plurality of ambient light levels measured over a time period by the one or more sensors, and wherein the determining the first ambient light level based at least in part on the first information received from the one or more sensors comprises:

determining the first ambient light level as an average of the plurality of ambient light levels over the time period.

3. The method of claim 1, wherein the generating the first color palette associated with the first ambient light level comprises:

selecting two or more predetermined color palettes from a plurality of predetermined color palettes based at least in part on the first ambient light level; and interpolating between the two or more predetermined color palettes based on the first ambient light level to generate the first color palette.

4. The method of claim 3, wherein:

each of the plurality of predetermined color palettes is associated with a different ambient light level; and the two or more predetermined color palettes selected from the plurality of predetermined color palettes are associated with ambient light levels that are closest to the first ambient light level.

5. The method of claim 1, wherein the determining the first screen brightness level associated with the first ambient light level comprises:

selecting two or more screen brightness levels from a plurality of screen brightness levels based at least in part on the first ambient light level; and interpolating between the two or more screen brightness levels using the first ambient light level to determine the first screen brightness level associated with the first ambient light level.

6. The method of claim 1, wherein:

one or more second graphical assets are associated with a second ambient light level;

the second ambient light level is different than the first ambient light level; and the one or more second graphical assets include at least one different graphical asset than the one or more first graphical assets.

7. The method of claim 1, wherein the display screen includes a plurality of pixels, and wherein the displaying the first image on the display screen using the first color palette and the first screen brightness level comprises:

illuminating a first number of pixels of the plurality of pixels as a first color based on one or more of the first color palette, the first screen brightness level, or the first ambient light level; and illuminating a second number of pixels of the plurality of pixels as a second color based on one or more of the first color palette, the first screen brightness level, or the first ambient light level.

8. The method of claim 7, wherein:

the first number of pixels is mapped to a first color index in a plurality of color palettes, the first color index being mapped to the first color and the first ambient light level; and the second number of pixels is mapped to a second color index in the plurality of color palettes, the second color index being mapped to the second color and the first ambient light level.

9. The method of claim 8, wherein:

the first color index is mapped to a non-black color at the first ambient light level; and the first color index is mapped to a black color at a second ambient light level.

10. The method of claim 1, further comprising:

determining that the first ambient light level changes to a second ambient light level;

generating a second color palette associated with the second ambient light level;

determining a second screen brightness level associated with the second ambient light level; and displaying a second image on the display screen based on the second color palette and the second screen brightness level.

11. The method of claim 1, further comprising:

determining a second ambient light level based at least in part on second information received from the one or more sensors;

modifying at least one of the one or more graphical assets included in the first image based at least in part on the second ambient light level; and displaying a second image on the display screen including the modified at least one graphical asset.

12. The method of claim 11, wherein the modifying comprises modifying a first layout of the at least one graphical asset of the first image to a second layout of the at least one graphical asset, the first layout being different than the second layout.

13. The method of claim 1, wherein the first color palette is generated based at least in part on processing capabilities of the display device.

14. An apparatus for adjusting color palettes for a display device based on ambient light levels, comprising:

means for determining a first ambient light level based at least in part on first information received from one or more sensors;

means for generating a first color palette associated with the first ambient light level;

means for determining a first screen brightness level associated with the first ambient light level; and means for displaying a first image on a display screen using the first color palette and the first screen brightness level, wherein the means for displaying the first image on the display screen using the first color palette and the first screen brightness level is configured to:

receive information associated with one or more first graphical assets associated with the first ambient light level and first timekeeping state information; and display the one or more first graphical assets and the timekeeping state information using the first color palette and the first screen brightness level.

15. The apparatus of claim 14, wherein the first information is associated with a plurality of ambient light levels measured over a time period by the one or more sensors, and wherein the means for determining the first ambient light level based at least in part on the first information received from the one or more sensors is configured to:

determine the first ambient light level as an average of the plurality of ambient light levels over the time period.

16. The apparatus of claim 14, wherein the means for generating the first color palette associated with the first ambient light level is configured to:

select two or more predetermined color palettes from a plurality of predetermined color palettes based at least in part on the first ambient light level; and interpolate between the two or more predetermined color palettes based on the first ambient light level to generate the first color palette.

17. The apparatus of claim 16, wherein:

each of the plurality of predetermined color palettes is associated with a different ambient light level; and the two or more predetermined color palettes selected from the plurality of predetermined color palettes are associated with ambient light levels that are closest to the first ambient light level.

18. The apparatus of claim 14, wherein the means for determining the first screen brightness level associated with the first ambient light level configured to:

select two or more screen brightness levels from a plurality of screen brightness levels based at least in part on the first ambient light level; and interpolate between the two or more screen brightness levels using the first ambient light level to determine the first screen brightness level associated with the first ambient light level.

19. The apparatus of claim 14, wherein:

one or more second graphical assets are associated with a second ambient light level;

the second ambient light level is different than the first ambient light level; and the one or more second graphical assets include at least one different graphical asset than the one or more first graphical assets.

20. The apparatus of claim 14, wherein the display screen includes a plurality of pixels, and wherein the means for displaying the first image on the display screen using the first color palette and the first screen brightness level is configured to:

illuminate a first number of pixels of the plurality of pixels as a first color based on one or more of the first color palette, the first screen brightness level, or the first ambient light level; and illuminate a second number of pixels of the plurality of pixels as a second color based on one or more of the first color palette, the first screen brightness level, or the first ambient light level.

21. The apparatus of claim 20, wherein:

the first number of pixels is mapped to a first color index in a plurality of color palettes, the first color index being mapped to the first color and the first ambient light level; and the second number of pixels is mapped to a second color index in the plurality of color palettes, the second color index being mapped to the second color and the first ambient light level.

22. The apparatus of claim 21, wherein:

the first color index is mapped to a non-black color at the first ambient light level; and the first color index is mapped to a black color at a second ambient light level.

23. The apparatus of claim 14, further comprising:

means for determining that the first ambient light level changes to a second ambient light level;

means for generating a second color palette associated with the second ambient light level;

means for determining a second screen brightness level associated with the second ambient light level; and means for displaying a second image on the display screen based on the second color palette and the second screen brightness level.

24. The apparatus of claim 14, further comprising:

means for determining a second ambient light level based at least in part on second information received from the one or more sensors;

means for modifying at least one of the one or more graphical assets included in the first image based at least in part on the second ambient light level; and means for displaying a second image on the display screen including the modified at least one graphical asset.

25. The apparatus of claim 24, further comprising means for modifying a first layout of the at least one graphical asset of the first image to a second layout of the at least one graphical asset of the second image, the first layout being different than the second layout.

26. The apparatus of claim 14, wherein the first color palette is generated based at least in part on processing capabilities of the display device.

27. An apparatus for adjusting color palettes for a display device based on ambient light levels, comprising:

a memory; and at least one processor coupled to the memory and configured to:

determine a first ambient light level based at least in part on first information received from one or more sensors;

generate a first color palette associated with the first ambient light level;

determine a first screen brightness level associated with the first ambient light level; and display a first image on a display screen using the first color palette and the first screen brightness level by:

receiving information associated with one or more first graphical assets associated with the first ambient light level and first timekeeping state information; and displaying the one or more first graphical assets and the timekeeping state information using the first color palette and the first screen brightness level.

28. The apparatus of claim 27, wherein the first information is associated with a plurality of ambient light levels measured over a time period by the one or more sensors, and wherein the at least one processor is configured to determine the first ambient light level based at least in part on the first information received from the one or more sensors by:

determining the first ambient light level as an average of the plurality of ambient light levels over the time period.

29. The apparatus of claim 27, wherein the at least one processor is configured to generate the first color palette associated with the first ambient light level by:

selecting two or more predetermined color palettes from a plurality of predetermined color palettes based at least in part on the first ambient light level; and interpolating between the two or more predetermined color palettes based on the first ambient light level to generate the first color palette.

30. The apparatus of claim 29, wherein:

each of the plurality of predetermined color palettes is associated with a different ambient light level; and the two or more predetermined color palettes selected from the plurality of predetermined color palettes are associated with ambient light levels that are closest to the first ambient light level.

31. The apparatus of claim 27, wherein the at least one processor is configured to determine the first screen brightness level associated with the first ambient light level by:

selecting two or more screen brightness levels from a plurality of screen brightness levels based at least in part on the first ambient light level; and interpolating between the two or more screen brightness levels using the first ambient light level to determine the first screen brightness level associated with the first ambient light level.

32. The apparatus of claim 27, wherein:

one or more second graphical assets are associated with a second ambient light level;

the second ambient light level is different than the first ambient light level; and the one or more second graphical assets include at least one different graphical asset than the one or more first graphical assets.

33. The apparatus of claim 27, wherein the display screen includes a plurality of pixels, and wherein the at least one processor is configured to display the first image on the display screen using the first color palette and the first screen brightness level by:

illuminating a first number of pixels of the plurality of pixels as a first color based on one or more of the first color palette, the first screen brightness level, or the first ambient light level; and illuminating a second number of pixels of the plurality of pixels as a second color based on one or more of the first color palette, the first screen brightness level, or the first ambient light level.

34. The apparatus of claim 33, wherein:

the first number of pixels is mapped to a first color index in a plurality of color palettes, the first color index being mapped to the first color and the first ambient light level; and the second number of pixels is mapped to a second color index in the plurality of color palettes, the second color index being mapped to the second color and the first ambient light level.

35. The apparatus of claim 34, wherein:

the first color index is mapped to a non-black color at the first ambient light level; and the first color index is mapped to a black color at a second ambient light level.

36. The apparatus of claim 27, wherein the at least one processor is further configured to:

determine that the first ambient light level changes to a second ambient light level;

generate a second color palette associated with the second ambient light level;

determine a second screen brightness level associated with the second ambient light level; and display a second image on the display screen based on the second color palette and the second screen brightness level.

37. The apparatus of claim 27, wherein the at least one processor is further configured to:

determine a second ambient light level based at least in part on second information received from the one or more sensors;

modify at least one of the one or more graphical assets included in the first image based at least in part on the second ambient light level; and display a second image on the display screen including the modified at least one graphical asset.

38. The apparatus of claim 37, wherein the at least one processor is further configured to modify a first layout of the at least one graphical asset of the first image to a second layout of the at least one graphical asset of the second image, the first layout being different than the second layout.

39. The apparatus of claim 27, wherein the at least one processor is further configured to generate the first color palette based at least in part on processing capabilities of the display device.

40. A non-transitory computer-readable medium storing computer executable code for adjusting color palettes for a display device based on ambient light levels, comprising code to:

determine a first ambient light level based at least in part on first information received from one or more sensors;

generate a first color palette associated with the first ambient light level;

determine a first screen brightness level associated with the first ambient light level;

receive information associated with one or more first graphical assets associated with the first ambient light level and first timekeeping state information; and display a first image on a display screen using the first color palette and the first screen brightness level by displaying the one or more first graphical assets and the timekeeping state information using the first color palette and the first screen brightness level.

41. The non-transitory computer-readable medium of claim 40, further comprising code to determine the first ambient light level as an average of a plurality of ambient light levels over a time period.

42. The non-transitory computer-readable medium of claim 40, further comprising code to:

select two or more predetermined color palettes from a plurality of predetermined color palettes based at least in part on the first ambient light level; and interpolate between the two or more predetermined color palettes based on the first ambient light level to generate the first color palette.

43. The non-transitory computer-readable medium of claim 42, wherein:

each of the plurality of predetermined color palettes is associated with a different ambient light level; and the two or more predetermined color palettes selected from the plurality of predetermined color palettes are associated with ambient light levels that are closest to the first ambient light level.

44. The non-transitory computer-readable medium of claim 40, further comprising code to:

select two or more screen brightness levels from a plurality of screen brightness levels based at least in part on the first ambient light level; and interpolate between the two or more screen brightness levels using the first ambient light level to determine the first screen brightness level associated with the first ambient light level.

45. The non-transitory computer-readable medium of claim 40, wherein:

one or more second graphical assets are associated with a second ambient light level;

the second ambient light level is different than the first ambient light level; and the one or more second graphical assets include at least one different graphical asset than the one or more first graphical assets.

46. The non-transitory computer-readable medium of claim 40, wherein the display screen includes a plurality of pixels, and wherein the code to display the first image on the display screen using the first color palette and the first screen brightness level is configured to:

illuminate a first number of pixels of the plurality of pixels as a first color based on one or more of the first color palette, the first screen brightness level, or the first ambient light level; and illuminate a second number of pixels of the plurality of pixels as a second color based on one or more of the first color palette, the first screen brightness level, or the first ambient light level.

47. The non-transitory computer-readable medium of claim 46, wherein:

the first number of pixels is mapped to a first color index in a plurality of color palettes, the first color index being mapped to the first color and the first ambient light level; and the second number of pixels is mapped to a second color index in the plurality of color palettes, the second color index being mapped to the second color and the first ambient light level.

48. The non-transitory computer-readable medium of claim 47, wherein:

the first color index is mapped to a non-black color at the first ambient light level; and the first color index is mapped to a black color at a second ambient light level.

49. The non-transitory computer-readable medium of claim 40, further comprising code to:

determine that the first ambient light level changes to a second ambient light level;

generate a second color palette associated with the second ambient light level;

determine a second screen brightness level associated with the second ambient light level; and display a second image on the display screen based on the second color palette and the second screen brightness level.

50. The non-transitory computer-readable medium of claim 40, further comprising code to:

determine a second ambient light level based at least in part on second information received from the one or more sensors;

modify at least one of the one or more graphical assets included in the first image based at least in part on the second ambient light level; and display a second image on the display screen including the modified at least one graphical asset.

51. The non-transitory computer-readable medium of claim 50, further comprising code to modify a first layout of the at least one graphical asset of the first image to a second layout of the at least one graphical asset of the second image, the first layout being different than the second layout.

52. The non-transitory computer-readable medium of claim 40, further comprising code to generate the first color palette based at least in part on processing capabilities of the display device.

* * * * *